US010726803B2

(12) United States Patent
Takahashi

(10) Patent No.: US 10,726,803 B2
(45) Date of Patent: Jul. 28, 2020

(54) ELECTRO-OPTICAL DEVICE, DRIVING METHOD FOR ELECTRO-OPTICAL DEVICE, AND ELECTRONIC APPARATUS

(71) Applicant: SEIKO EPSON CORPORATION, Tokyo (JP)

(72) Inventor: Nariya Takahashi, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/134,031

(22) Filed: Sep. 18, 2018

(65) Prior Publication Data

US 2019/0088221 A1 Mar. 21, 2019

(30) Foreign Application Priority Data

Sep. 19, 2017 (JP) ..... 2017-179582

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 3/3696* (2013.01); *G09G 2310/0248* (2013.01); *G09G 2310/0297* (2013.01); *G09G 2310/08* (2013.01)

(58) Field of Classification Search
CPC ..... G09G 2310/0248; G09G 2310/0251
See application file for complete search history.

(56) References Cited

U.S. PATENT DOCUMENTS 5,959,600 A * 9/1999 Uchino ..... G09G 3/3688 345/94
2003/0151564 A1* 8/2003 Yamashita ..... G09G 3/3648 345/52
2003/0179164 A1* 9/2003 Shin ..... G09G 3/3233 345/76
2012/0056917 A1 3/2012 Ito
2015/0154926 A1 6/2015 Fujikawa

FOREIGN PATENT DOCUMENTS

JP 2012-053407 A 3/2012
JP 2015-072328 A 4/2015
JP 2015-087586 A 5/2015
JP 2015-106108 A 6/2015

* cited by examiner

*Primary Examiner* — Roy P Rabindranath
(74) *Attorney, Agent, or Firm* — Oliff PLC

(57) ABSTRACT

An electro-optical device includes a first pixel provided corresponding to intersection of a first data line and a scanning line, a second pixel provided corresponding to intersection of a second data line and the scanning line, a data signal circuit configured to supply a first data signal to the first pixel via the first data line in a first period and supply a second data signal to the second pixel via the second data line in a second period that is started after completion of the first period, and a pre-charge circuit configured to supply a second pre-charge signal to the second data line in the first period after supplying a first pre-charge signal to the second data line in the first period.

8 Claims, 13 Drawing Sheets

ELECTRO-OPTICAL DEVICE, DRIVING METHOD FOR ELECTRO-OPTICAL DEVICE, AND ELECTRONIC APPARATUS

The entire disclosure of Japanese Patent Application No. 2017-179582, filed Sep. 19, 2017 is expressly incorporated by reference herein.

BACKGROUND

1. Technical Field

The disclosure relates to an electro-optical device, a driving method for the electro-optical device, and an electronic apparatus.

2. Related Art

It is conceivable to provide an electro-optical device that writes data signals into a plurality of pixels via a plurality of signal lines and causes each pixel to display a gray-scale level corresponding to the written data signal. In this electro-optical device, in some cases, a pre-charge signal having a predetermined potential is supplied to each signal line to enhance display quality (for example, JP-A-2012-53407).

However, when the pre-charge signal is supplied to each of the plurality of signal lines prior to the writing of the data signal into each pixel, a write time of the data signal may be shortened.

SUMMARY

The disclosure provides a technology that can supply a pre-charge signal while securing a write time of a data signal.

One aspect of an electro-optical device according to the disclosure includes a first pixel provided corresponding to intersection of a first data line and a scanning line, a second pixel provided corresponding to intersection of a second data line and the scanning line, a data signal circuit configured to supply a first data signal to the first pixel via the first data line in a first period and supply a second data signal to the second pixel via the second data line in a second period that is started after completion of the first period, and a pre-charge circuit configured to supply a second pre-charge signal to the second data line in the first period after supplying a first pre-charge signal to the second data line in the first period.

In one aspect of the electro-optical device, in the first period, a time during which the data signal is written can be sufficiently secured, compared with a configuration in which a period for supplying the pre-charge signal is provided for each of a plurality of data lines. Thus, according to the aspect, the pre-charge signal can be supplied while the time during which the data signal is written is secured.

The electro-optical device according to one aspect described above further includes a third pixel provided corresponding to intersection of a third data line and a scanning line. The pre-charge circuit may be configured to supply the first pre-charge signal to the second data line in a first supply period, supply the second pre-charge signal to the second data line in a second supply period, supply the first pre-charge signal to the third data line in a third supply period, and supply the second pre-charge signal to the third data line in a fourth supply period, the data signal circuit may be configured to supply a third data signal to the third pixel via the third data line in a third period that is started after completion of the second period, the first supply period and the second supply period may be included in the first period, and the third supply period and the fourth supply period may be included in a period from a start of the first period to completion of the second period.

According to this aspect, in the first period, the pre-charge signal can be supplied while the time during which the data signal is written is sufficiently secured, compared with the configuration in which a period for supplying the pre-charge signal is provided for each of a plurality of data lines.

In a first aspect of the electro-optical device described above, a time at which the first supply period is started may be approximately equal to a time at which the third supply period is started, and a time at which the fourth supply period is started may be later than a time at which the second supply period is started. According to this aspect, influence of variation in a potential that is caused in the case that the supply of the second pre-charge signal is started can be reduced, compared with the configuration in which the second and fourth supply periods are started at an identical time.

In a second aspect of the electro-optical device described above, a time at which the third supply period is started may be later than a time at which the first supply period is started, and a time at which the fourth supply period is started may be later than a time at which the second supply period is started. According to this aspect, influence of variation in a potential that is caused in the case that the supply of the first pre-charge signal is started can be reduced, compared with a configuration in which the first and third supply periods are started at an identical time. Furthermore, influence of variation in a potential that is caused in the case that the supply of the second pre-charge signal is started can be reduced, compared with a configuration in which the second and fourth supply periods are started at an identical time.

In a third aspect of the electro-optical device described above, a length of time ranging from a start of the first supply period to a start of the second supply period and a length of time ranging from a start of the third supply period to a start of the fourth supply period may be approximately equal. According to this aspect, the length of time during which the first pre-charge signal is held in the second data line and the length of time during which the first pre-charge signal is held in the third data line are approximately equal, and thus the effects of supplying the first pre-charge signal can be uniformized in the second and third data lines.

In one aspect of the disclosure, a potential of the second pre-charge signal may change from a first potential set to the first pre-charge signal to a second potential different from the first potential over a period in which the second pre-charge signal is supplied to the second data line in the first period. According to this aspect, influence of variation in a potential of the pre-charge signal can be reduced because the potential of the pre-charge signal gradually changes from the first potential to the second potential, compared with a case in which the potential of the pre-charge signal suddenly changes.

The electro-optical device according to the aspect described above further includes a plurality of scanning lines including the scanning line, and a scanning line drive circuit configured to sequentially select the plurality of scanning lines. The scanning line drive circuit may be configured to select the scanning line corresponding to the first pixel, the second pixel, and the third pixel in a horizontal period including the first period, the second period, and the third period. According to this aspect, in the first period, the pre-charge signal can be supplied while the time during which the data signal is written is sufficiently secured, compared with the configuration in which a period for supplying the pre-charge signal is provided for each of a plurality of data lines.

In addition, the disclosure can be understood as a driving method for the electro-optical device described above. Specifically, the disclosure is a driving method for an electro-optical device including a first pixel provided corresponding to intersection of a first data line and a scanning line, and a second pixel provided corresponding to intersection of a second data line and the scanning line. The disclosure can be understood as a driving method for the electro-optical device configured to supply a first data signal to the first pixel via the first data line in a first period and supply a second data signal to the second pixel via the second data line in a second period that is started after completion of the first period, and supply a second pre-charge signal to the second data line after supplying a first pre-charge signal to the second data line in the first period. According to this aspect, in the first period, the pre-charge signal can be supplied while the time during which the data signal is written is sufficiently secured, compared with the configuration in which a period for supplying the pre-charge signal is provided for each of a plurality of data lines.

In addition, an electronic apparatus according to the disclosure includes any of the aspects of the electro-optical device described above. For example, a projection-type display apparatus (e.g., a projector), a personal computer, and a smart phone correspond to an example of the electronic apparatus.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, exemplary embodiments for carrying out the disclosure will be described with reference to accompanying drawings. However, in each drawing, a size and scale of each portion is different from the actual size and scale of each portion as appropriate. In addition, several exemplary embodiments described below are several specific examples of the disclosure, and various technically appropriate limitations are applied, but the scope of the disclosure is not limited to these embodiments unless a description to the effect that the disclosure is specifically limited is made in the explanation below.

1. First Exemplary Embodiment

1.1 Summary of Configuration of Electro-Optical Device 10

Figure 1:
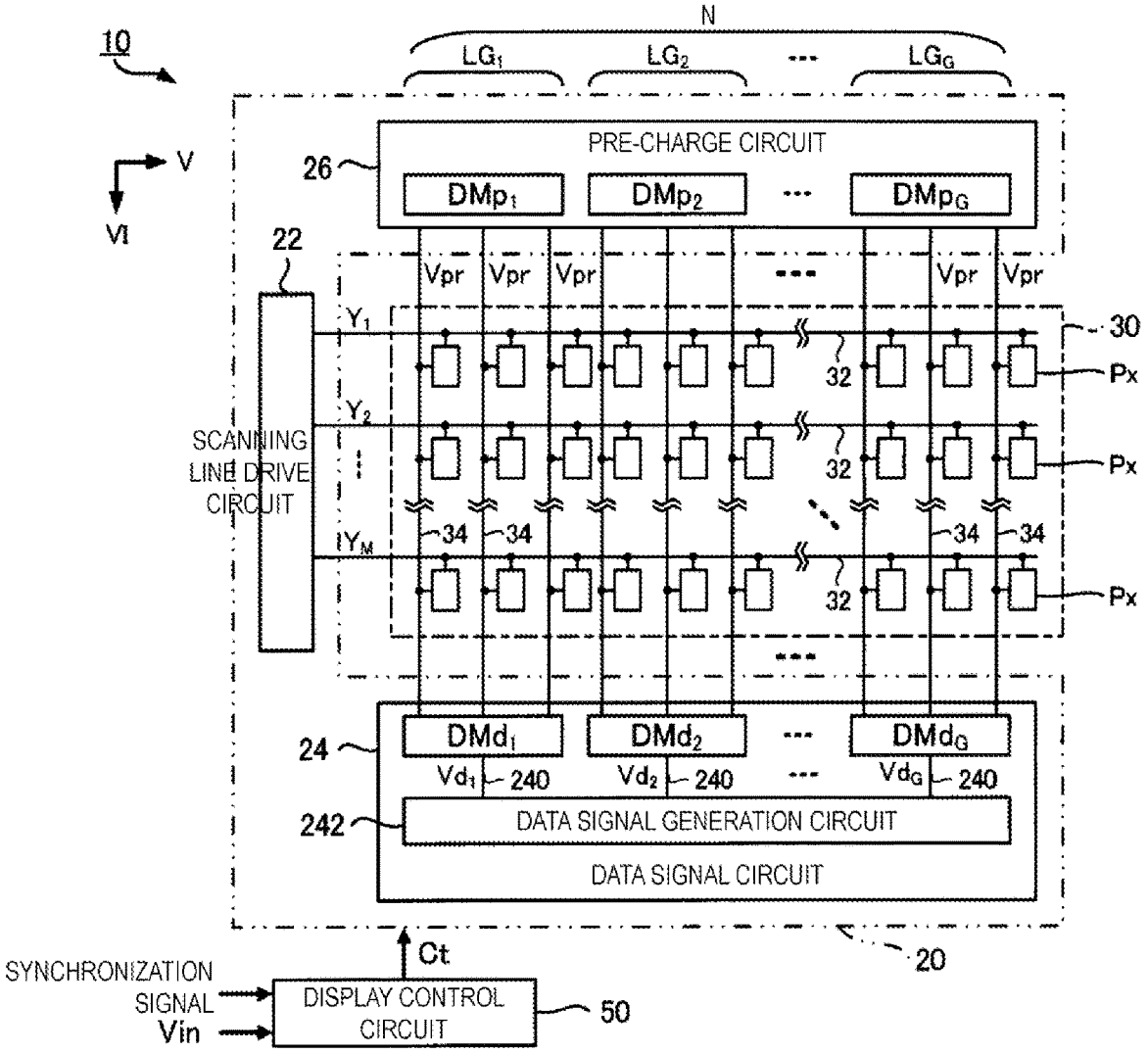
FIG. 1 is a block diagram of an electro-optical device according to a first exemplary embodiment of the disclosure.

FIG. 1 is a block diagram of an electro-optical device 10 according to a first exemplary embodiment of the disclosure. The electro-optical device 10 is a liquid crystal device mounted on various electronic apparatuses as a display device that displays images. As illustrated in FIG. 1, the electro-optical device 10 includes a display unit 30 that includes a plurality of pixels Px, a drive circuit 20 that drives each pixel Px, and a display control circuit 50 that controls the drive circuit 20.

As illustrated in FIG. 1, M scanning lines 32 extending in a V direction and N data lines 34 extending in a VI direction intersecting with the V direction are formed in the display unit 30 (M and N are integers of one or greater). As illustrated in FIG. 1, the N data lines 34 provided in the display unit 30 are divided into G wire line groups LG ($LG_1$ to $LG_G$) (G is an integer of one or greater). Each wire line group LG includes R data lines 34 (G=N/R. R is an integer of two or greater). In the first exemplary embodiment, a case in which R is three is exemplified and described. The plurality of pixels Px is arrayed in vertical M columns and horizontal N rows corresponding to the intersections of the scanning lines 32 and the data lines 34. Note that, in the first exemplary embodiment, a description is made by exemplifying a case in which the pixels Px are provided corresponding to the whole of the (M×N) intersections, but the pixels Px may be provided in part of the (M×N) intersections.

The display control circuit 50 generates a control signal Ct for controlling the drive circuit 20 on the basis of an image data Vin and a synchronization signal supplied from a high-order circuit (not illustrated) and supplies the control signal Ct to the drive circuit 20. The image data Vin, for example, is data that defines a gray-scale level to be displayed by each pixel Px. A vertical synchronization signal Vsync that defines a vertical scanning period F, a horizontal synchronization signal Hsync that defines a horizontal scanning period H, an image signal Vid that designates a gray-scale level of each pixel Px, and various selective signals described later are included in the control signal Ct that the display control circuit 50 generates.

The drive circuit 20 drives each pixel Px such that each pixel Px displays a gray-scale level in accordance with the image signal Vid. The drive circuit 20 includes a scanning line drive circuit 22, a data signal circuit 24, and a pre-charge circuit 26.

The scanning line drive circuit 22 supplies scanning signals $Y_1$ to $Y_M$ to the scanning lines 32 in the first to M-th rows. More specifically, the scanning line drive circuit 22 supplies the scanning signal $Y_m$ to the scanning line 32 in an m-th row (m is an integer that satisfies $1 \leq m \leq M$). The scanning line drive circuit 22 sequentially selects the M canning lines 32 by sequentially setting the scanning signals $Y_1$ to $Y_M$ to a predetermined selective potential Vsw. For example, the scanning line drive circuit 22 selects the scanning line 32 in the m-th row by setting the selective potential Vsw to the scanning signal $Y_m$.

The data signal circuit 24 supplies, via each data line 34, a data signal Vd to the pixel Px corresponding to the data line 34. The data signal circuit 24 includes G demultiplexers $DMd_1$ to $DMd_G$ corresponding to the G wire line groups $LG_1$ to $LG_G$ on a one-to-one basis and a data signal generation circuit 242 that generates data signals Vd ($Vd_1$ to $Vd_G$) of G systems on the basis of the control signal Ct supplied from the display control circuit 50. As illustrated in FIG. 1, each of G demultiplexers $DMd_1$ to $DMd_G$ and the data signal generation circuit 242 are coupled with a signal line 240. The data signal circuit 24 supplies the data signal $Vd_g$ in a time division manner to R (three in the first exemplary embodiment) data lines 34 included in the wire line group $LG_g$ corresponding to the demultiplexer $DMd_g$ (g is an integer that satisfies $1 \leq g \leq G$).

The pre-charge circuit 26 supplies a pre-charge signal Vpr to the data lines 34. The pre-charge circuit 26 includes G demultiplexers $DMp_1$ to $DMp_G$ corresponding to the G wire line groups $LG_1$ to $LG_G$ on a one-to-one basis.

1.2. Detailed Configuration of Electro-Optical Device 10

Figure 2:
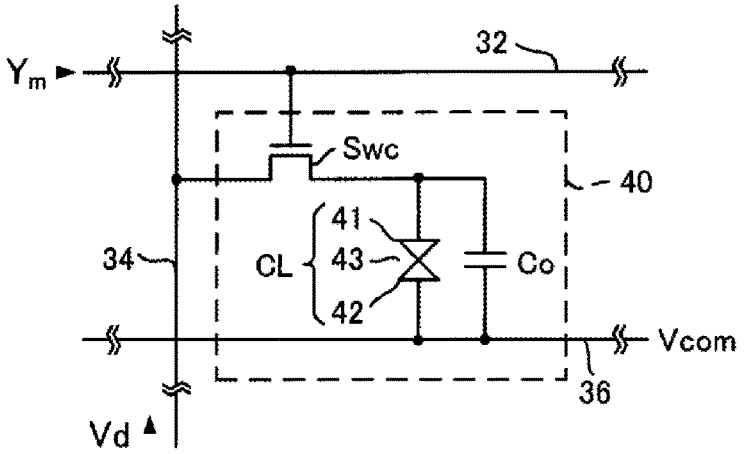
FIG. 2 is a circuit diagram of a pixel circuit.

FIG. 2 is a circuit diagram of a pixel circuit 40 corresponding to each pixel Px. As illustrated in FIG. 2, each pixel circuit 40 includes a liquid crystal element CL, a selective switch Swc, and a capacitance Co. The liquid crystal element CL is an electro-optical element that includes a pixel electrode 41, a common electrode 42, and a liquid crystal 43 provided between the pixel electrode 41 and the common electrode 42. When a voltage is applied to the liquid crystal element CL (that is, between the pixel electrode 41 and the common electrode 42), the transmittance of the liquid crystal element CL is changed in accordance with a magnitude of the applied voltage. Each pixel Px displays a gray-scale level in accordance with the transmittance of the corresponding liquid crystal element CL. Note that, in the first exemplary embodiment, a description is made by exemplifying a normally black mode in which the pixel Px appears black (the transmittance of the liquid crystal element CL is 0%) in a state in which a voltage is not applied to the liquid crystal element CL.

The common electrode 42 is electrically coupled with a capacitance line 36 kept at a constant voltage Vcom and set to a predetermined reference potential Vref. One end of the capacitance Co is electrically coupled with the capacitance line 36 and the other end of the capacitance Co is electrically coupled with the pixel electrode 41.

The selective switch Swc, for example, is an N-channel type transistor, provided between the pixel electrode 41 and the data line 34, and allows electrical coupling (conduction or non-conduction) between the pixel electrode 41 and the data line 34 to be controlled. Specifically, the gate of the selective switch Swc is electrically coupled with the scanning line 32. Then, when the scanning signal $Y_m$ supplied to the scanning line 32 in the m-th row is set to the selective potential Vsw, the selective switch Swc provided in the image circuit 40 of each pixel Px corresponding to the scanning line 32 in the m-th row is put in an on state. When the selective switch Swc is put in an on state, the pixel electrode 41 and the data line 34 are electrically connected, and the potential of the pixel electrode 41 corresponds to a potential corresponding to the data signal Vd supplied to the data line 34. As a result, a voltage corresponding to the data signal Vd is applied to the liquid crystal 43. Thus, the transmittance of the liquid crystal element CL of the pixel circuit 40 changes in accordance with the data signal Vd, and the pixel Px corresponding to the pixel circuit 40 displays a gray-scale level in accordance with the data signal Vd. Note that, in the Description, "the data signal Vd is supplied to the pixel electrode 41, and a potential corresponding to the data signal Vd is set" may be represented as "the data signal Vd is written into the pixels Px".

Figure 3:
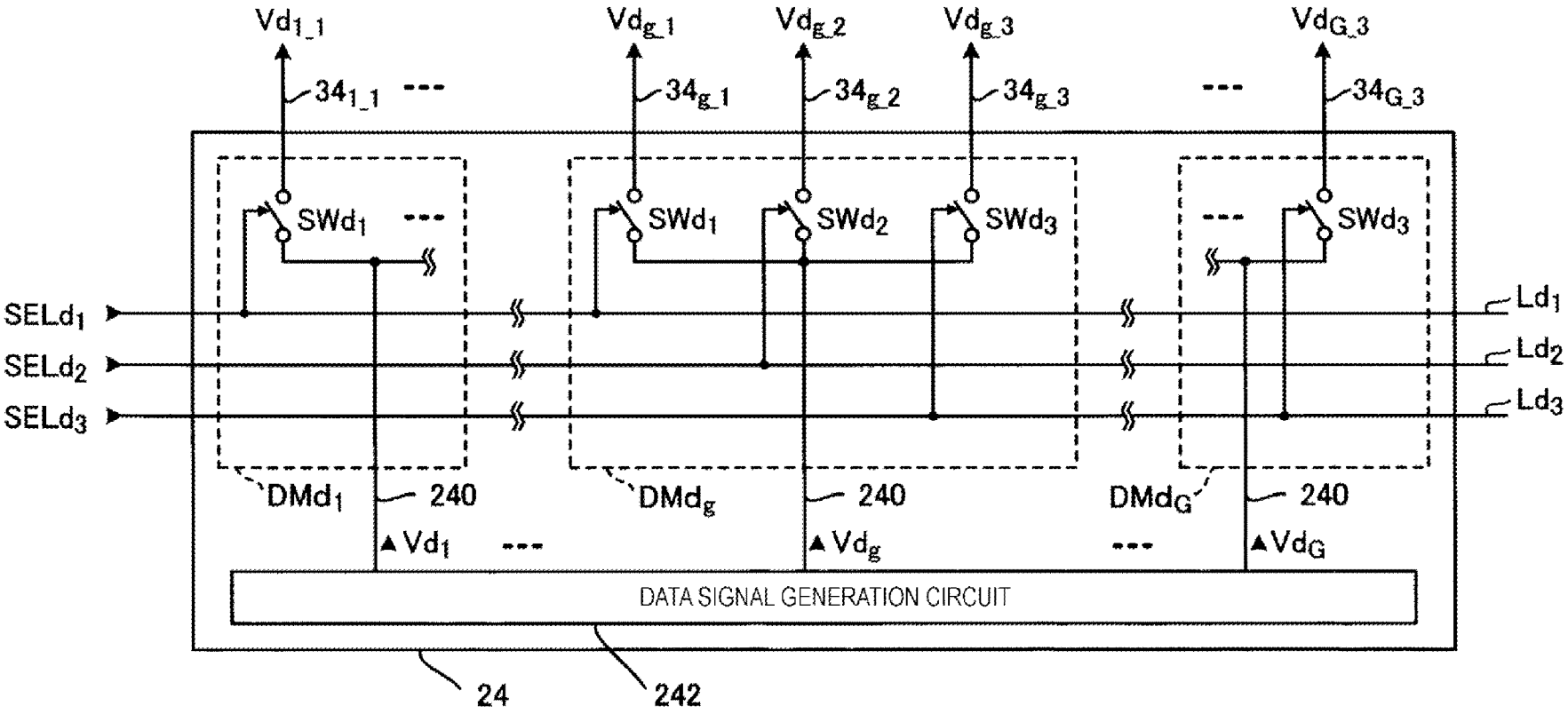
FIG. 3 is an explanatory diagram of a data signal circuit.

FIG. 3 is a diagram for illustrating a data signal circuit 24. For the convenience of illustration, in FIG. 3, the configuration example of a g-th demultiplexer $DMd_g$ out of the G demultiplexers $DMd_1$ to $DMd_G$ included in the data signal circuit 24 is illustrated. As illustrated in FIG. 3, R electric power feeder lines Ld ($Ld_1$ to $LD_R$) to which selective signals $SELd_1$ to $SELd_R$ are supplied are disposed in the data signal circuit 24. In the data signal circuit 24, a selective signal $SELd_r$ is supplied to an electric power feeder line $Ld_r$ (r is an integer that satisfies $1 \leq r \leq R$). The selective signals $SELd_1$ to $SELd_R$ are signals included in the control signal Ct supplied from the display control circuit 50. The display control circuit 50 sequentially sets a predetermined selective potential Vseld to the selective signals $SELd_1$ to $SELd_R$. As described above, in the first exemplary embodiment, a case in which R is three is assumed. The demultiplexer $DMd_g$ includes R switches SWd ($SWd_1$ to $SWd_R$) corresponding to R (three) data lines 34 (referred to as $\mathbf{34}_g$) included in the wire line group $LG_g$ on a one-to-one basis. Each of the R switches SWd, as is the case with the selective switch Swc of the pixel circuit 40, for example, is an N-channel type transistor. The r-th switch $SWd_r$ out of the R switches SWd is provided between the r-th data line 34*g* (referred to as $\mathbf{34}_{g_r}$) out of the R data lines 34*g* and the signal line 240 corresponding to the demultiplexer $DMd_g$ and allows electrical coupling (conduction or non-conduction) between the r-th data line 34*g* and the signal line 240 to be controlled. Specifically, the gate of the switch $Swd_r$ is electrically coupled with the r-th electric power feeder line $Ld_r$. Then, when the selective signal $SELd_r$ supplied to the electric power feeder line $Ld_r$ is set to the selective potential Vseld, the switch $Swd_r$ is put in an on state. When the switch $Swd_r$ included in the demultiplexer $DMd_g$ is put in an on state, the data line $\mathbf{34}_{g_r}$, and the signal line 240 are electrically connected, and the data signal $Vd_g$ is supplied to the data line $\mathbf{34}_{g_r}$. Thus, when the selective signal $SELd_r$ is set to the selective potential Vseld, the r-th switch $SWd_r$ of each of the G demultiplexers $DMd_1$ to $DMd_G$ is put in an on state.

As described above, the R switches Swd included in the demultiplexer $DMd_g$ are sequentially put in an on state, and thus the data signal circuit 24 supplies the data signal $Vd_g$ in a time division manner to each of the R data lines $\mathbf{34}_{g1}$ to $\mathbf{34}_{g_R}$. Hereinafter, in a case that the switch $Swd_r$ is in an on state, the data signal $Vd_g$ supplied to the data line $\mathbf{34}_{g_r}$ is referred to as a data signal $Vd_{g_r}$. The data signal $Vd_{g_r}$ is a signal for designating a gray-scale level to be displayed by the pixel Px corresponding to the intersection of the data line $\mathbf{34}_{g_r}$ and the selected scanning line 32.

Figure 4:
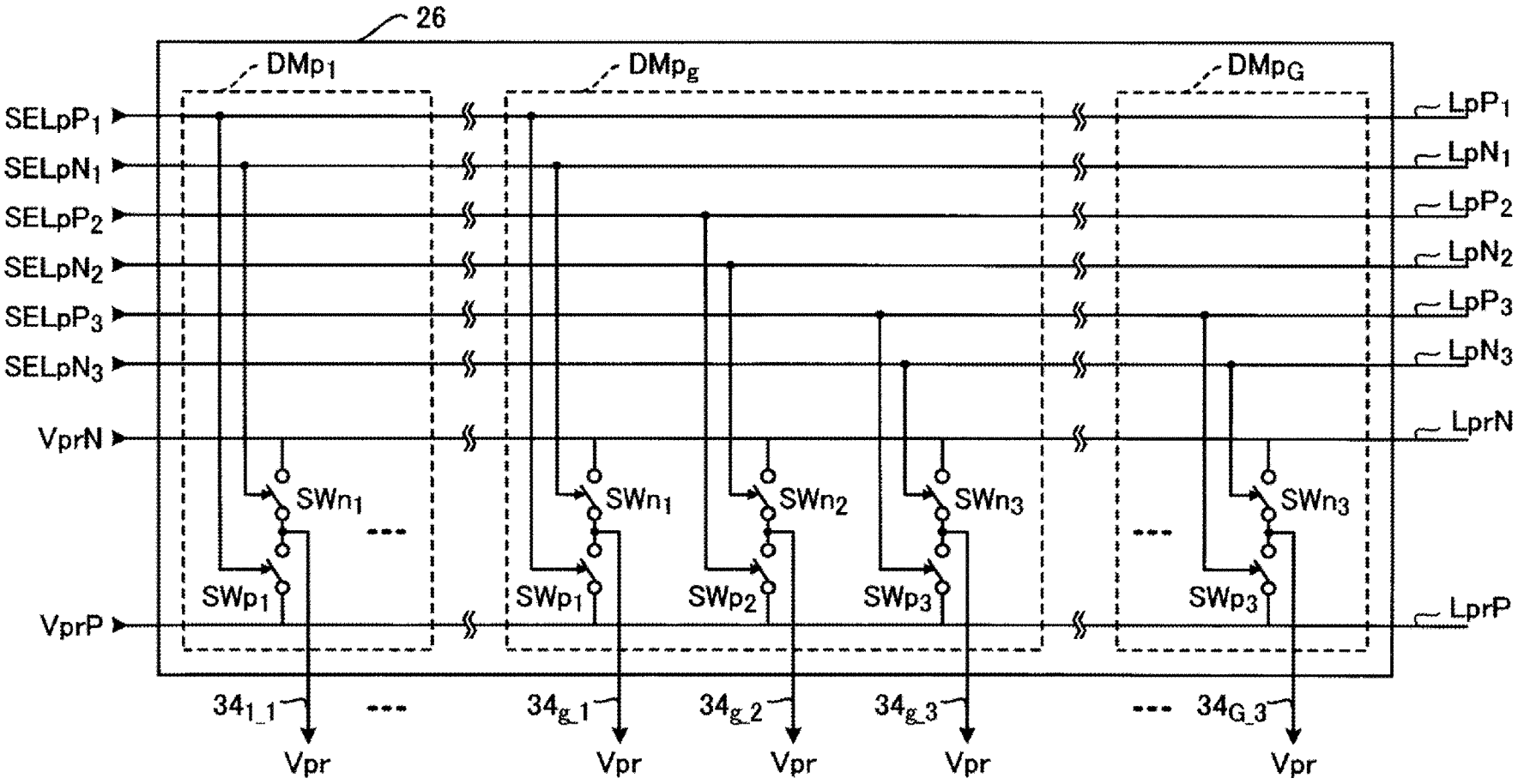
FIG. 4 is an explanatory diagram of a pre-charge circuit.

FIG. 4 is a diagram for illustrating a pre-charge circuit 26. For the convenience of illustration, in FIG. 4, the configuration example of a g-th demultiplexer $DMp_g$ out of the G demultiplexers $DMp_1$ to $DMp_G$ included in the pre-charge circuit 26 is illustrated. As illustrated in FIG. 4, the demultiplexer $DMp_g$ includes R switches SWp ($SWp_1$ to $SWp_R$) and R switches SWn ($SWn_1$ to $SWn_R$). In addition, a positive electric power feeder line LprP to which a positive-polarity pre-charge signal VprP is supplied, a negative electric power feeder line LprN to which a negative-polarity pre-charge signal VprN is supplied, R electric power feeder lines LpP ($LpP_1$ to $LpP_R$) to which selective signals $SELpP_1$ to $SELpP_R$ are supplied, and R electric power feeder lines LpN ($LpN_1$ to $LpN_R$) to which selective signals $SELpN_1$ to $SELpN_R$ are supplied are disposed in the pre-charge circuit 26. Hereinafter, the positive electric power feeder line LprP and the negative electric power feeder line LprN may be collectively referred to as an electric power feeder line Lpr. The positive-polarity pre-charge signal VprP, the negative-polarity pre-charge signal VprN, the selective signals $SELpP_1$ to $SELpP_R$, and the selective signals $SELpN_1$ to $SELpN_R$ are signals included in the control signal Ct supplied from the display control circuit 50.

In the Description, "pre-charge signal Vpr" is a general term of the positive-polarity pre-charge signal VprP and the negative-polarity pre-charge signal VprN. In addition, the positive-polarity pre-charge signal VprP is a general term of a first positive-polarity pre-charge signal VprP1 and a second positive-polarity pre-charge signal VprP2 described later. Similarly, the negative-polarity pre-charge signal VprN is a general term of a first negative-polarity pre-charge signal VprN1 and a second negative-polarity pre-charge signal VprN2 described later. In addition, hereinafter, the first positive-polarity pre-charge signal VprP1 and the first negative-polarity pre-charge signal VprN1 may be collectively referred to as a first pre-charge signal Vpr1, and the second positive-polarity pre-charge signal VprP2 and the second negative-polarity pre-charge signal VprN2 may be collectively referred to as a second pre-charge signal Vpr2.

The R switches $SWp_1$ to $SWp_R$ included in the demultiplexer $DMp_g$ are provided corresponding to the R data lines $\mathbf{34}_{g_1}$ to $\mathbf{34}_{g_R}$ included in the G wire line group $LG_g$ on a one-to-one basis. Each of the R switches SWp, for example, is an N-channel type transistor. The r-th switch $SWp_r$ out of the R switches SWp is provided between the data line $\mathbf{34}_{g_r}$ and the positive electric power feeder line LprP and allows electrical coupling (conduction or non-conduction) between the data line $\mathbf{34}_{g_r}$ and the positive electric power feeder line LprP to be controlled. Specifically, the gate of the switch $SWp_r$ is electrically coupled with the electric power feeder line $LpP_r$. Then, when the selective signal $SELpP_r$ supplied to the electric power feeder line $LpP_r$ is set to a predetermined positive selective potential VselpP by the display control circuit 50, the switch $SWp_r$ is put in an on state. When the switch $SWp_r$ included in the demultiplexer $DMp_g$ is put in an on state, the data line $\mathbf{34}_{g_r}$ and the positive electric power feeder line LprP are electrically connected, and the positive-polarity pre-charge signal VprP is supplied to the data line $\mathbf{34}_{g_r}$.

Thus, when the selective signal $SELpP_r$ is set to the positive selective potential VselpP, the r-th switch $SWp_r$ of each of the G demultiplexers $DMp_1$ to $DMp_G$ is put in an on state.

Similarly, the R switches $SWn_1$ to $SWn_R$ included in the demultiplexer $DMp_g$ are provided corresponding to the R data lines $\mathbf{34}_{g_1}$ to $\mathbf{34}_{g_R}$ on a one-to-one basis. Each of the R switches SWn, for example, is an N-channel type transistor. The r-th switch SWn, out of the R switches SWn is provided between the data line $\mathbf{34}_{g_r}$ and the negative electric power feeder line LprN and allows electrical coupling (conduction or non-conduction) between the data line $\mathbf{34}_{g_r}$ and the negative electric power feeder line LprN to be controlled. Specifically, the gate of the switch $SWn_r$ is electrically coupled with the electric power feeder line $LpN_r$. Then, when the selective signal $SELpN_r$ supplied to the electric power feeder line $LpN_r$ is set to a predetermined negative selective potential VselpN by the display control circuit 50, the switch $SWn_r$ is put in an on state. When the switch $SWn_r$ included in the demultiplexer $DMp_g$ is put in an on state, the data line $\mathbf{34}_{g_r}$ and the negative electric power feeder line LprN are electrically connected, and the negative-polarity pre-charge signal VprN is supplied to the data line $\mathbf{34}_{g_r}$. The potential of the negative selective potential VselpN may be identical to or different from the potential of the positive selective potential VselpP.

Thus, when the selective signal $SELpN_r$ is set to the negative selective potential VselpN, the r-th switch $SWn_r$ of each of the G demultiplexers $DMp_1$ to $DMp_G$ is put in an on state.

1.3. Operation of Electro-Optical Device 10

Figure 5:
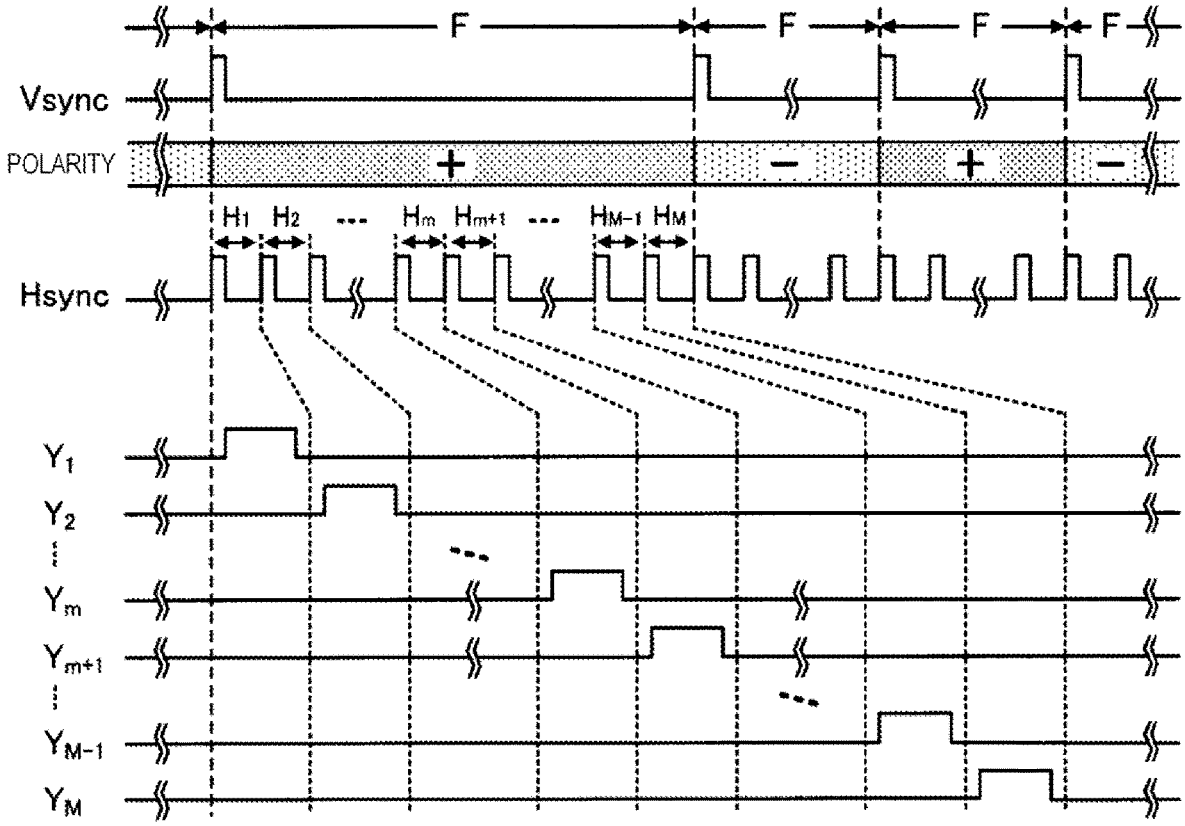
FIG. 5 is a timing chart for illustrating an operation period of an electro-optical device according to the first exemplary embodiment.

FIG. 5 is a timing chart for illustrating an operation period of the electro-optical device 10. In the first exemplary embodiment, the operation period of the electro-optical device 10 includes a plurality of vertical scanning periods F. More specifically, the operation period of the electro-optical device 10 is divided by the vertical synchronization signal Vsync into the plurality of vertical scanning periods F, and each vertical scanning period F is divided by the horizontal synchronization signal Hsync into M horizontal scanning periods H ($H_1$ to $H_M$). As illustrated in FIG. 5, the scanning line drive circuit 22 selects the scanning line 32 in the m-th row in the m-th horizontal scanning period $H_m$ out of the M horizontal scanning periods H included in each vertical scanning period F. More specifically, the scanning line drive circuit 22 sets the scanning signal $Y_m$ supplied to the scanning line 32 in the m-th row to the selective potential Vsw in the horizontal scanning period $H_m$ and sets scanning signals $Y_1$ to $Y_{m-1}$ and $Y_{m+1}$ to $Y_M$, except for the scanning signal $Y_m$, to a non-selective potential different from the selective potential Vsw. Note that, in the first exemplary embodiment, it is assumed that the selective potential Vsw is higher than the non-selective potential, but the selective potential Vsw may be lower than the non-selective potential.

When the scanning line drive circuit 22 selects the scanning line 32 in the m-th row, the selective switch Swc included in each of N pixels Px arrayed in the m-th row is put in an on state, and a voltage in accordance with the potential of the corresponding data line 34 is applied to the liquid crystal element CL of each of the N pixels Px. Thus, each pixel Px arrayed in the m-th row displays a gray-scale level in accordance with the potential of the corresponding data line 34. The data signal circuit 24 and the pre-charge circuit 26 control the potential of each of the N data lines (that is, supplies the data signal Vd and the pre-charge signal Vpr to each of the N data lines 34) in synchronism with the selection of the scanning lines 32 by the scanning line drive circuit 22.

Note that, as illustrated in FIG. 5, in the first exemplary embodiment, the polarity of the voltage applied to the liquid crystal element CL is switched between positive polarity ("+" is illustrated in FIG. 5) and negative polarity ("−" is illustrated in FIG. 5) for each vertical scanning period F. Specifically, the polarity of the voltage applied to the liquid crystal element CL is the positive polarity in a case that the potential (referred to as a data potential VdLv) of the data signal Vd is higher than the reference potential Vref set to the common electrode 42, and the polarity of the voltage applied to the liquid crystal element CL is the negative polarity in a case that the data potential VdLv is lower than the reference potential Vref. Hereinafter, in some cases, when the data signal circuit 24 sets a potential higher than the reference potential Vref to the data signal Vd, it is represented that the electro-optical device 10 is in a positive polarity driving mode, and when the data signal circuit 24 sets a potential lower than the reference potential Vref to the data signal Vd, it is represented that the electro-optical device 10 is in a negative polarity driving mode.

Figure 6:
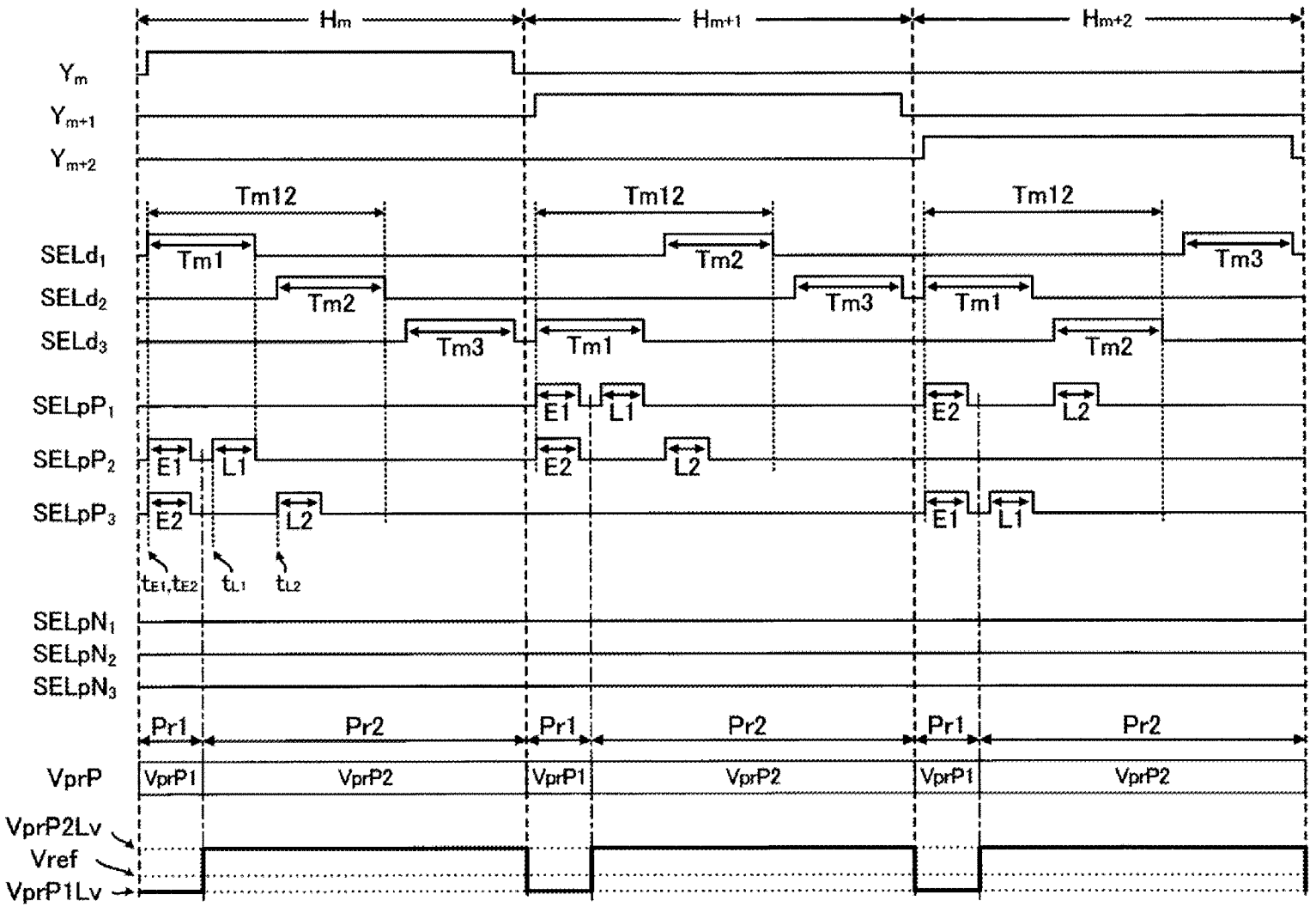
FIG. 6 is a timing chart for illustrating an operation of an electro-optical device according to the first exemplary embodiment.
Figure 7:
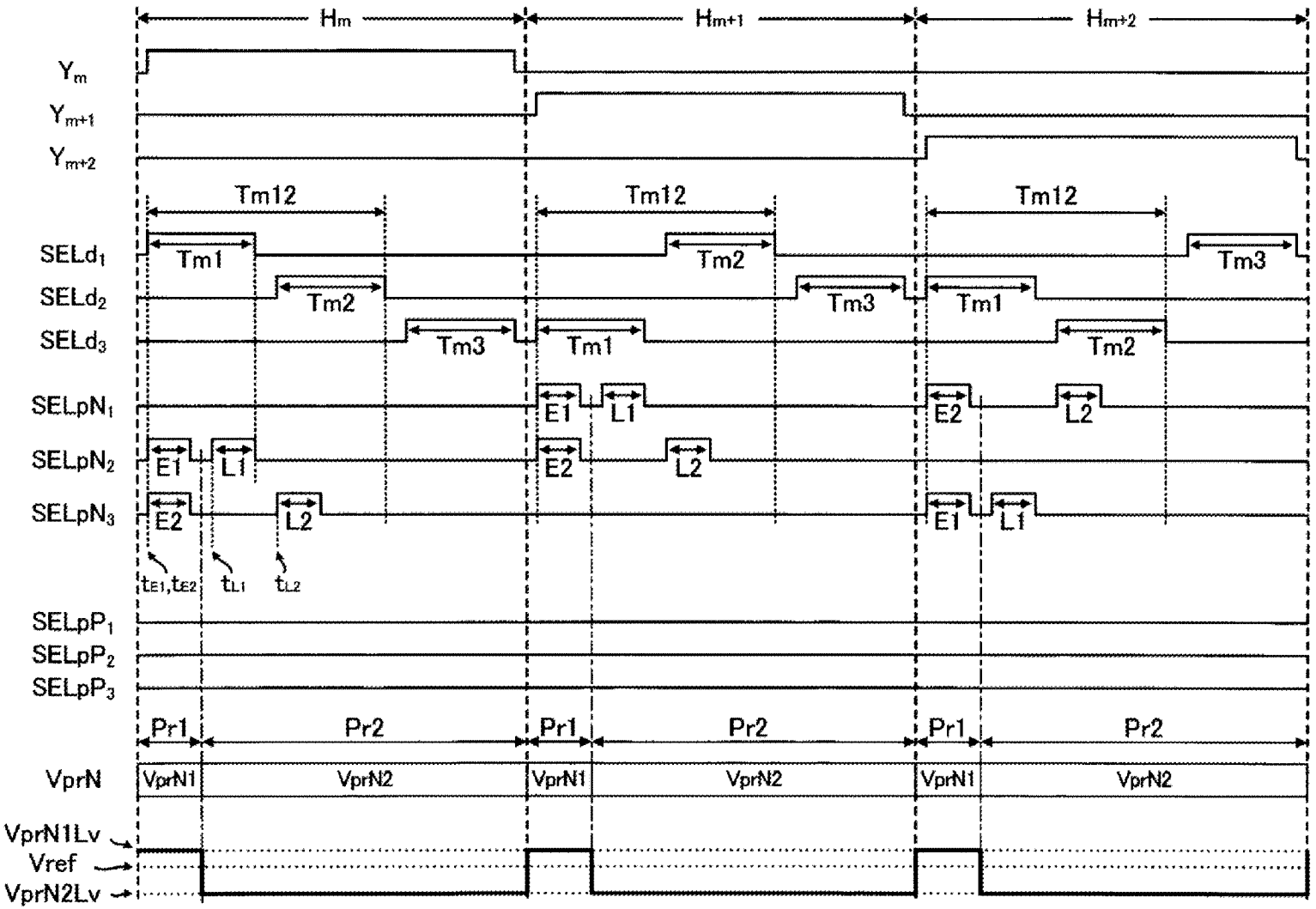
FIG. 7 is a timing chart for illustrating an operation of an electro-optical device according to the first exemplary embodiment.

FIGS. 6 and 7 are timing charts for illustrating one example of the operation of the electro-optical device 10 according to the first exemplary embodiment. FIG. 6 indicates a timing chart in a case that the electro-optical device 10 is in the positive polarity driving mode, and FIG. 7 indicates a timing chart in a case that the electro-optical device 10 is in the negative polarity driving mode. In FIGS. 6 and 7, the operations from the horizontal scanning period $H_m$ to the horizontal scanning period $H_{m+2}$ out of the operation periods of the electro-optical device 10 are exemplified and described.

In addition, hereinafter, for the convenience of descriptions, the R (three in the first exemplary embodiment) data line 34*g* ($\mathbf{34}_{8_1}$, $\mathbf{34}_{g_2}$, and $\mathbf{34}_{g_3}$) included in one wire line group $GL_g$ are focused and described.

In the first exemplary embodiment, each horizontal scanning period H includes R selective periods Tm (Tm1 to TmR). The r-th selective period Tmr is a period that starts after the completion of a (r−1)-th selective period Tm(r−1). In addition, in the first exemplary embodiment, the drive circuit 20, in each horizontal scanning period H, supplies the data signal Vd to Q data lines 34*g* after supplying the pre-charge signal Vpr, out of the R data lines 34*g* included in the wire line group $LG_g$ and supplies the data signal Vd to (R−Q) data lines 34*g* without supplying the pre-charge signal Vpr (Q is an integer that satisfies 1≤Q≤R). Hereinafter, there is a case in which the data line 34 to be pre-charged, to which the pre-charge signal Vpr is supplied in one horizontal scanning period H, is referred to as a data line 34K, and the data line 34 not to be pre-charged, to which the pre-charge signal Vpr is not supplied in the one horizontal scanning period H, is referred to as a data line 34N. In other words, the R data lines 34*g* included in the wire line group $LG_g$ are classified into Q data lines $\mathbf{34}_g$K and J data lines $\mathbf{34}_g$N (J=R−Q).

The data signal circuit 24 supplies the data signal Vd to one data line 34*g* out of the R data lines 34*g* included in the wire line group $LG_g$ in each selective period Tm. More specifically, the data signal circuit 24 sequentially supplies the data signal Vd to the J data lines $\mathbf{34}_g$N included in the wire line group $LG_g$ in selective periods Tm1 to TmJ (that is, selective periods Tm1 to Tm(R−Q)). More specifically, the data signal circuit 24 supplies the data signal Vd to the J-th data line $\mathbf{34}_g$Nj out of the J data lines $\mathbf{34}_g$N in the selective period Tmj (j is an integer that satisfies 1≤j≤J). In addition, the data signal circuit 24 sequentially supplies the data signal Vd to the Q data lines $\mathbf{34}_g$K included in the wire line group $LG_g$ in selective periods Tm(J+1) to TmR (that is, selective periods Tm(R−Q+1) to TmR). More specifically, the data signal circuit 24 supplies the data signal Vd to the q-th data line $\mathbf{34}_g$Kq out of the Q data lines $\mathbf{34}_g$K in a selective period Tm(R−Q+q) (q is an integer that satisfies 1≤q≤Q).

The pre-charge circuit 26 supplies the first pre-charge signal Vpr1 and the second pre-charge signal Vpr2 to the Q data lines $\mathbf{34}_g$K included in the wire line group $LG_g$ in the selective periods Tm1 to Tm(R−1). Hereinafter, a period in which the first pre-charge signal Vpr1 is supplied to the data line $\mathbf{34}_g$Kq is referred to as a supply period Eq, and a period in which the second pre-charge signal Vpr2 is supplied to the data line $\mathbf{34}_g$Kq is referred to as a supply period Lq.

The supply period Eq is a period included in the selective periods Tm1 to Tm(R−Q) and completes before the start of the supply period Lq. In the first exemplary embodiment, a case in which the start times of the supply periods E1 to EQ are approximately equal is exemplified is described. Note that "approximately equal" is a concept that includes a case of being equal in terms of design and being regarded as equal, for example, in consideration of an error attributed to a manufacturing error of the electro-optical device 10, in addition to the case of "completely equal".

The supply period Lq is a period included in the selective periods Tm(R−Q) to Tm(R−1) and completes before the start of the selective period Tm (R−Q+q) in which the data signal Vd is supplied to the data line $\mathbf{34}_g$Kq. In the first exemplary embodiment, an example in which the supply period Lq is included in a selective period Tm(R−Q+q−1) is described. In addition, in the first exemplary embodiment, a case in which a start time $t_{Lq}$ at which the supply period Lq is started is later than a start time $t_{L(q-1)}$ at which the supply period L(q−1) is started is exemplified and described.

In the first exemplary embodiment, each horizontal scanning period H is divided into a pre-charge period Pr1 and a pre-charge period Pr2. The pre-charge period Pr1 is a period that includes the supply periods E1 to EQ, and the pre-charge period Pr2 is a period that includes the supply periods L1 to LQ. The pre-charge circuit 26 supplies the first pre-charge signal Vpr1 (VprP1 or VprN1) to the electric power feeder line Lpr (LprP or LprN) in the pre-charge period Pr1 and supplies the second pre-charge signal Vpr2 (VprP2 or VprN2) to the electric power feeder line Lpr in the pre-charge period Pr2.

When the electro-optical device 10 is in the positive polarity driving mode, the pre-charge circuit 26, for example, supplies the first positive-polarity pre-charge signal VprP1 to the data line $\mathbf{34}_{g_r}$ included in the wire line group $LG_g$ in a period in which the positive selective potential VselpP is set to the selective signal $SELpP_r$, in the pre-charge period Pr1. In addition, the pre-charge circuit 26, for example, supplies the second positive-polarity pre-charge signal VprP2 to the data line $\mathbf{34}_{g_r}$ included in the wire line group $LG_g$ in a period in which the positive selective potential VselpP is set to the selective signal $SELpP_r$, in the pre-charge period Pr2.

Similarly, when the electro-optical device 10 is in the negative polarity driving mode, the pre-charge circuit 26, for example, supplies the first negative-polarity pre-charge signal VprN1 to the data line $\mathbf{34}_{g_r}$ included in the wire line group $LG_g$ in a period in which the negative selective potential VselpN is set to the selective signal $SELpN_r$, in the pre-charge period Pr1. In addition, the pre-charge circuit 26, for example, supplies the second negative-polarity pre-charge signal VprN2 to the data line $\mathbf{34}_{g_r}$ included in the wire line group $LG_g$ in a period in which the negative selective potential VselpN is set to the selective signal $SELpN_r$, in the pre-charge period Pr2.

Note that, in the first exemplary embodiment, R horizontal scanning periods H are regarded as one cycle, and the pre-charge signal Vpr is supplied to each date line 34 Q times for the one cycle (in Q horizontal scanning periods H).

For example, "M" which is the number of horizontal scanning periods H included in each vertical scanning period F is set to a number (e.g., a multiple of R) identical to the number of times the pre-charge signal Vpr is supplied to each data line 34 in each vertical scanning period F but may be set to another number.

As illustrated in FIGS. 6 and 7, in the first exemplary embodiment, a case in which R=3, and Q=2 is exemplified and described. That is, in FIGS. 6 and 7, a case in which the wire line group $LG_g$ includes two (Q) data lines $\mathbf{34}_g$K1 and $\mathbf{34}_g$K2 to be pre-charged and one (J) data line $\mathbf{34}_g$N1 not to be pre-charged is exemplified. In addition, in FIGS. 6 and 7, a case in which each horizontal scanning period H includes three (R) selective periods Tm1 to Tm3 is exemplified. The selective period Tm2 is started after the completion of the selective period Tm1, and the selective period Tm3 is started after the completion of the selective period Tm2.

In addition, in the example illustrated in FIGS. 6 and 7, in the selective periods Tm1 to TmJ, that is, the selective period Tm1, the data signal Vd is supplied to the one (J) data line $\mathbf{34}_g$N1 in the wire line group $LG_g$, and in selective periods Tm(J+1) to TmR, that is, the selective periods Tm2 and Tm3, the data signal Vd is supplied to the two (Q) data lines $\mathbf{34}_g$K1 and $\mathbf{34}_g$K2 in the wire line group $LG_g$. In addition, in the example illustrated in FIGS. 6 and 7, in each horizontal scanning period H, the supply periods E1 and E2 in which the first pre-charge signal Vpr1 is supplied to the data lines $\mathbf{34}_g$K1 and $\mathbf{34}_g$K2 are included in the selective periods Tm1 to TmJ, that is, the selective period Tm1, and the supply periods L1 and L2 in which the second pre-charge signal Vpr2 is supplied to the data lines $\mathbf{34}_g$K1 and $\mathbf{34}_g$K2 are included in the selective periods TmJ to Tm(R−1), that is, the selective periods Tm1 and Tm2.

Note that, in FIGS. 6 and 7, as one example, a case in which the supply period L1 is included in the selective period Tm1, and the supply period L2 is included in the selective period Tm2 is assumed.

One selective period Tm out of the selective periods Tm1 to TmJ in which the data signal Vd is supplied to the J data lines $\mathbf{34}_g$N is one example of "first period". In addition, one selective period Tm except for the selective period TmR out of the selective periods Tm(J+1) to TmR in which the data signal Vd is supplied to the Q data lines $\mathbf{34}_g$K is one example of "second period", and other selective period Tm out of the selective periods Tm(J+1) to TmR, which is started after the completion of the one selective period Tm, is one example of "third period". That is, in the example illustrated in FIGS. 6 and 7, the selective period Tm1 is one example of "first period", and the selective period Tm2 is one example of "second period", and the selective period Tm3 is one example of "third period". Hereinafter, a period from the start of the selective period Tm1 to the completion of the selective period Tm2 is referred to as a selective period Tm12.

Note that, in the first exemplary embodiment, R selective periods Tm1 to TmR included in each horizontal scanning period H are approximately identical to each other in terms of length of time. That is, in FIGS. 6 and 7, it is assumed that the length of time of the selective period Tm1, the selective period Tm2, and the selective period Tm3 is approximately equal.

1.3.1. Operation in Positive Polarity

Hereinafter, a case in which the electro-optical device 10 is in the positive polarity driving mode will be described with reference to FIG. 6.

In the horizontal scanning period $H_m$, the scanning line drive circuit 22 selects the scanning line 32 in the m-th row. Hereinafter, pixels provided corresponding to the intersections between the scanning line 32 selected by the scanning line drive circuit 22 and each of the data line $\mathbf{34}_{g_1}$, $\mathbf{34}_{g_2}$, and $\mathbf{34}_{g_3}$ are referred to as Px1, Px2, and Px3, respectively. In the horizontal scanning period $H_m$, the data line $\mathbf{34}_{g_1}$ is the data line $\mathbf{34}_g$N1, the data line $\mathbf{34}_{g_2}$ is the data line $\mathbf{34}_g$K1, and the data line $\mathbf{34}_{g_3}$ is the data line $\mathbf{34}_g$K2.

As illustrated in FIG. 6, in the selective period Tm1 of the horizontal scanning period $H_m$, the selective signal $SELd_1$ is set to the selective potential Vseld. As a result, in the selective period Tm1 of the horizontal scanning period $H_m$, the data signal circuit 24 supplies the data signal $Vd_{g_1}$ (one example of "first data signal") to the data line $\mathbf{34}_{g_1}$ (one example of "first data line"). In other words, in the selective period Tm1 of the horizontal scanning period $H_m$, the data signal circuit 24 supplies the data signal $Vd_{g_1}$ to the pixel Px1 (one example of "first pixel") via the data line $\mathbf{34}_{g_1}$.

In the selective period Tm2 of the horizontal scanning period $H_m$, the selective signal $SELd_2$ is set to the selective potential Vseld, and the data signal circuit 24 supplies the data signal $Vd_{g_2}$ (one example of "second data signal") to the data line $\mathbf{34}_{g_2}$ (one example of "second data line"). In other words, in the selective period Tm2 of the horizontal scanning period $H_m$, the data signal circuit 24 supplies the data signal $Vd_{g_2}$ to the pixel Px2 (one example of "second pixel") via the data line $\mathbf{34}_{g_2}$.

In the selective period Tm3 of the horizontal scanning period $H_m$, the selective signal $SELd_3$ is set to the selective potential Vseld, and the data signal circuit 24 supplies the data signal $Vd_{g_3}$ (one example of "third data signal") to the data line $\mathbf{34}_{g_3}$ (one example of "third data line"). In other words, in the selective period Tm3 of the horizontal scanning period $H_m$, the data signal circuit 24 supplies the data signal $Vd_{g_3}$ to the pixel Px3 (one example of "third pixel") via the data line $\mathbf{34}_{g_3}$.

As described above, in the horizontal scanning period $H_m$, the data line $\mathbf{34}_{g_1}$ is the data line $\mathbf{34}_g$N not to be pre-charged. Thus, in the horizontal scanning period $H_m$, the positive selective potential VselpP is not set to the selective signal $SELpP_1$, and the positive-polarity pre-charge signal VprP is not supplied to the data line $\mathbf{34}_{g_1}$.

The selective signal $SELpP_2$ is set to the positive selective potential VselpP in the supply period E1 (one example of "first supply period") and the supply period L1 (one example of "second supply period") included in the selective period Tm1 of the horizontal scanning period $H_m$. As illustrated in FIG. 6, the first positive-polarity pre-charge signal VprP1 is supplied to the positive electric power feeder line LprP in the pre-charge period Pr1 including the supply period E1, and the second positive-polarity pre-charge signal VprP2 is supplied to the positive electric power feeder line LprP in the pre-charge period Pr2 including the supply period L1. As a result, after supplying the first positive-polarity pre-charge signal VprP1 (one example of "first pre-charge signal") to the data line $\mathbf{34}_{g_2}$ in the selective period Tm1 of the horizontal scanning period $H_m$, the pre-charge circuit 26 supplies the second positive-polarity pre-charge signal VprP2 (one example of "second pre-charge signal") to the data line $\mathbf{34}_{g_2}$ in the selective period Tm1. More specifically, the pre-charge circuit 26 supplies the first positive-polarity pre-charge signal VprP1 to the data line $\mathbf{34}_{g_2}$ in the supply period E1 and supplies the second positive-polarity pre-charge signal VprP2 to the data line $\mathbf{34}_{g_2}$ in the supply period L1.

Note that, in the first exemplary embodiment, the polarity of the potential of the first positive-polarity pre-charge signal VprP1 (which is referred to as a first positive pre-charge potential VprP1Lv and which is one example of "first potential") is set opposite to the polarity of the data signal Vd (negative polarity in the example of FIG. 6). In addition, the polarity of the potential of the second positive-polarity pre-charge signal VprP2 (which is referred to as a second positive pre-charge potential VprP2Lv and which is one example of "second potential") is set identical to the polarity of the data signal Vd (positive polarity in the example of FIG. 6). That is, the second positive pre-charge potential VprP2Lv is a potential different from the first positive pre-charge potential VprP1Lv. The second positive pre-charge potential VprP2Lv, for example, may be set to a potential in the center of amplitude of the data potential VdLv or a mean value of the data potential VdLv.

In the horizontal scanning period $H_m$, the selective signals $SELpP_3$ is set to the positive selective potential VselpP in the supply period E2 (one example of "third supply period") and the supply period L2 (one example of "fourth supply period"). The supply period E2 and the supply period L2 are periods included in the selective period Tm12 from the start of the selective period Tm1 to the completion of the selective period Tm2. As illustrated in FIG. 6, the supply period E2 is included in the pre-charge period Pr1, and the supply period L2 is included in the pre-charge period Pr2. As a result, the pre-charge circuit 26 supplies the first positive-polarity pre-charge signal VprP1 to the data line $34_{g_3}$ in the supply period E2 and supplies the second positive-polarity pre-charge signal VprP2 to the data line $34_{g_3}$ in the supply period L2.

As illustrated in FIG. 6, in the first exemplary embodiment, the start time $t_{E1}$ of the supply period E1 is approximately equal to the start time $t_{E2}$ of the supply period E2. In addition, the start time $t_{L2}$ of the supply period L2 is later than the start time $t_{L1}$ of the supply period L1. Note that, in FIG. 6, an example in which the start time $t_{L2}$ of the supply period L2 is approximately identical to the start time of the selective period Tm2 is illustrated, but the disclosure is not limited to this example. In a case where the supply period L2 is included in the period Tm12, the start time $t_{L2}$ may be later than the start time of the selective period Tm2.

Furthermore, in the first exemplary embodiment, a case in which the supply period Lq is included in the selective period Tm(R−Q+q−1) is exemplified, but in a case where the supply period Lq terminates before the start of the selective period Tm(R−Q+q), the supply period Lq may be included in the selective period Tm (e.g., selective period Tm(R−Q+q−2)) prior to the selective period Tm(R−Q+q−1). For example, in the example illustrated in FIG. 6, in a case where the start time $t_{L2}$ of the supply period L2 is later than the start time $t_{L1}$ of the supply period L1, the start time $t_{L2}$ may be earlier than the start time of the selective period Tm2. In this case, the supply period L2 may span the selective periods Tm1 and Tm2.

Next, operations in the horizontal scanning period $H_{m+1}$ will be described. In the horizontal scanning period $H_{m+1}$, the scanning line drive circuit 22 selects the scanning line 32 in the (m+1)-th row. In the horizontal scanning period $H_{m+1}$, the data line $34_{g_3}$ is the data line $34_g$N1, the data line $34_{g_1}$ is the data line $34_g$K1, and the data line $34_{g_2}$ is the data line $34_g$K2.

In the selective period Tm1 of the horizontal scanning period $H_{m+1}$, the selective signal $SELd_3$ is set to the selective potential Vseld. As a result, in the selective period Tm1 of the horizontal scanning period $H_{m+1}$, the data signal circuit 24 supplies the data signal $Vd_{g_3}$ to the data line $34_{g_3}$. In other words, in the selective period Tm1 of the horizontal scanning period $H_{m+1}$, the data signal circuit 24 supplies the data signal $Vd_{g_3}$ to the pixel Px3 via the data line $34_{g_3}$.

Similarly, in the selective period Tm2 of the horizontal scanning period $H_{m+1}$, the selective signal $SELd_1$ is set to the selective potential Vseld, and in the selective period Tm2 of the horizontal scanning period $H_{m+1}$, the data signal circuit 24 supplies the data signal $Vd_{g_1}$ to the pixel Px1 via the data line $34_{g_1}$.

In the selective period Tm3 of the horizontal scanning period $H_{m+1}$, the selective signal $SELd_2$ is set to the selective potential Vseld, and in the selective period Tm3 of the horizontal scanning period $H_{m+1}$, the data signal circuit 24 supplies the data signal $Vd_{g_2}$ to the pixel Px2 via the data line $34_{g_2}$.

In the horizontal scanning period $H_{m+1}$, the data line $34_{g_3}$ is one example of "first data signal", the data line $34_{g_1}$ is one example of "second data signal", and the data line $34_{g_2}$ is one example of "third data signal". In addition, in the horizontal scanning period $H_{m+1}$, the data signal $Vd_{g_3}$ is one example of "first data signal", the data signal $Vd_{g_1}$ is one example of "second data signal", and the data signal $Vd_{g_2}$ is one example of "third data signal". In addition, in the horizontal scanning period $H_{m+1}$, the pixel Px3 is one example of "first pixel", the pixel Px1 is one example of "second pixel", and the pixel Px2 is one example of "third pixel".

In the horizontal scanning period $H_{m+1}$, the selective signal $SELpP_3$ is not set to the positive selective potential VselpP, and the positive-polarity pre-charge signal VprP is not supplied to the data line $34_{g_3}$.

The selective signal $SELpP_1$ is set to the positive selective potential VselpP in the supply period E1 and the supply period L1 included in the selective period Tm1 of the horizontal scanning period $H_{m+1}$. As a result, the pre-charge circuit 26 supplies the first positive-polarity pre-charge signal VprP1 to the data line $34_{g_1}$ in the supply period E1 and supplies the second positive-polarity pre-charge signal VprP2 to the data line $34_{g_1}$ in the supply period L1.

The selective signal $SELpP_2$ is set to the positive selective potential VselpP in the supply period E2 and the supply period L2 included in the selective period Tm12 of the horizontal scanning period $H_{m+1}$. As a result, the pre-charge circuit 26 supplies the first positive-polarity pre-charge signal VprP1 to the data line $34_{g_2}$ in the supply period E2 and supplies the second positive-polarity pre-charge signal VprP2 to the data line $34_{g_2}$ in the supply period L2.

Next, operations in the horizontal scanning period $H_{m+2}$ will be described. In the horizontal scanning period $H_{m+2}$, the scanning line drive circuit 22 selects the scanning line 32 in the (m+2)-th row. In the horizontal scanning period $H_{m+2}$, the data line $34_{g_2}$ is the data line $34_g$N1, the data line $34_{g_3}$ is the data line $34_g$K1, and the data line $34_{g_1}$ is the data line $34_g$K2.

In the selective period Tm1 of the horizontal scanning period $H_{m+2}$, the selective signal $SELd_2$ is set to the selective potential Vseld. As a result, in the selective period Tm1 of the horizontal scanning period $H_{m+2}$, the data signal circuit 24 supplies the data signal $Vd_{g_2}$ to the data line $34_{g_2}$. In other words, in the selective period Tm1 of the horizontal scanning period $H_{m+2}$, the data signal circuit 24 supplies the data signal $Vd_{g_2}$ to the pixel Px2 via the data line $34_{g_2}$.

Similarly, in the selective period Tm2 of the horizontal scanning period $H_{m+2}$, the selective signal $SELd_3$ is set to the selective potential Vseld, and in the selective period Tm2 of the horizontal scanning period $H_{m+2}$, the data signal circuit 24 supplies the data signal $Vd_{g_3}$ to the pixel Px3 via the data line $34_{g_3}$.

In the selective period Tm3 of the horizontal scanning period $H_{m+2}$, the selective signal $SELd_1$ is set to the selective potential Vseld, and in the selective period Tm3 of the horizontal scanning period $H_{m+2}$, the data signal circuit 24 supplies the data signal $Vd_{g_1}$ to the pixel Px1 via the data line $\mathbf{34}_{g_1}$.

Note that, in the horizontal scanning period $H_{m+2}$, the data line $\mathbf{34}_{g_2}$ is one example of "first data line", the data line $\mathbf{34}_{g_3}$ is one example of "second data line", and the data line $\mathbf{34}_{g_1}$ is one example of "third data line". In addition, in the horizontal scanning period $H_{m+2}$, the data signal $Vd_{g_2}$ is one example of "first data signal", the data signal $Vd_{g_3}$ is one example of "second data signal", and the data signal $Vd_{g_1}$ is one example of "third data signal". In addition, in the horizontal scanning period $H_{m+2}$, the pixel Px2 is one example of "first pixel", the pixel Px3 is one example of "second pixel", and the pixel Px1 is one example of "third pixel".

In the horizontal scanning period $H_{m+2}$, the selective signal $SELpP_2$ is not set to the positive selective potential VselpP, and the positive-polarity pre-charge signal VprP is not supplied to the data line $\mathbf{34}_{g_2}$.

The selective signal $SELpP_3$ is set to the positive selective potential VselpP in the supply period E1 and the supply period L1 included in the selective period Tm1 of the horizontal scanning period $H_{m+2}$. As a result, the pre-charge circuit 26 supplies the first positive-polarity pre-charge signal VprP1 to the data line $\mathbf{34}_{g_3}$ in the supply period E1 and supplies the second positive-polarity pre-charge signal VprP2 to the data line $\mathbf{34}_{g_3}$ in the supply period L1.

The selective signal $SELpP_1$ is set to the positive selective potential VselpP in the supply period E2 and the supply period L2 included in the selective period Tm12 of the horizontal scanning period $H_{m+2}$. As a result, the pre-charge circuit 26 supplies the first positive-polarity pre-charge signal VprP1 to the data line $\mathbf{34}_{g_1}$ in the supply period E2 and supplies the second positive-polarity pre-charge signal VprP2 to the data line $\mathbf{34}_{g_1}$ in the supply period L2.

As described above, in the first exemplary embodiment, the three (R) horizontal scanning periods $H_m$ to $H_{m+2}$, are regarded as one cycle, and the positive-polarity pre-charge signal VprP (VprP1 and VprP2) is supplied to each of the three date line $\mathbf{34}_{g_1}$ to $\mathbf{34}_{g_3}$ two (Q) times for the one cycle.

Note that, in the first exemplary embodiment, the case in which R=3, and Q=2 has been exemplified and described, but a number substituted into R and Q exemplified in the first exemplary embodiment is one example, and another number may be substituted. For example, R=8, and Q=4 may be applied. In this case, in the eight horizontal scanning periods H as one cycle, the pre-charge circuit 26 may supply the pre-charge signal Vpr to each data line 34 four times for the one cycle (or to each data line 34 two times for one cycle, where the four horizontal scanning periods H are regarded as the one cycle).

Note that, as illustrated in FIG. 6, in a case that the electro-optical device 10 is in the positive polarity driving mode, the negative selective potential VselpN is not set to the selective signals $SELpN_1$ to $SELpN_3$.

1.3.2. Operation in Negative Polarity

Next, a difference between the case in which the electro-optical device 10 is in the negative polarity driving mode and the case in which the electro-optical device 10 is in the positive polarity driving mode will be described with reference to FIG. 7. FIG. 7 is different from FIG. 6 in that the selective signals $SELpN_1$ to $SELpN_3$ are set to the negative selective potential VselpN, and the negative-polarity pre-charge signal VprN (VprN1 and VprN2) is supplied to the date lines $\mathbf{34}_g$. That is, in the example illustrated in FIG. 7, the first negative-polarity pre-charge signal VprN1 is supplied to the negative electric power feeder line LprN in the pre-charge period Pr1, and the second negative-polarity pre-charge signal VprN2 is supplied to the negative electric power feeder line LprN in the pre-charge period Pr2.

In the example illustrated in FIG. 7, the pre-charge circuit 26 supplies the first negative-polarity pre-charge signal VprN1 (one example of "first pre-charge signal") in the supply periods E1 and E2 and supplies the second negative-polarity pre-charge signal VprN2 (one example of "second pre-charge signal") in the supply periods L1 and L2.

More specifically, in the supply periods E1 and L1 of the horizontal scanning period $H_m$, a selective signal $SELpN_2$ is set to the negative selective potential VselpN. As a result, the pre-charge circuit 26 supplies the first negative-polarity pre-charge signal VprN1 to the data line $\mathbf{34}_{g_2}$ in the supply period E1 of the horizontal scanning period $H_m$ and supplies the second negative-polarity pre-charge signal VprN2 to the data line $\mathbf{34}_{g_2}$ in the supply period L1 of the horizontal scanning period $H_m$. In addition, in the supply periods E2 and L2 of the horizontal scanning period $H_m$, a selective signal $SELpN_3$ is set to the negative selective potential VselpN. As a result, the pre-charge circuit 26 supplies the first negative-polarity pre-charge signal VprN1 to the data line $\mathbf{34}_{g_3}$ in the supply period E2 of the horizontal scanning period $H_m$ and supplies the second negative-polarity pre-charge signal VprN2 to the data line $\mathbf{34}_{g_3}$ in the supply period L2 of the horizontal scanning period $H_m$.

In the supply periods E1 and L1 of the horizontal scanning period $H_{m+1}$, the selective signal $SELpN_1$ is set to the negative selective potential VselpN. As a result, the pre-charge circuit 26 supplies the first negative-polarity pre-charge signal VprN1 to the data line $\mathbf{34}_{g_1}$ in the supply period E1 of the horizontal scanning period $H_{m+1}$ and supplies the second negative-polarity pre-charge signal VprN2 to the data line $\mathbf{34}_{g1}$ in the supply period L1 of the horizontal scanning period $H_{m+1}$. In addition, in the supply periods E2 and L2 of the horizontal scanning period $H_{m+1}$, the selective signal $SELpN_2$ is set to the negative selective potential VselpN. As a result, the pre-charge circuit 26 supplies the first negative-polarity pre-charge signal VprN1 to the data line $\mathbf{34}_{g_2}$ in the supply period E2 of the horizontal scanning period $H_{m+1}$ and supplies the second negative-polarity pre-charge signal VprN2 to the data line $\mathbf{34}_{g_2}$ in the supply period L2 of the horizontal scanning period $H_{m+1}$.

In the supply periods E1 and L1 of the horizontal scanning period $H_{m+2}$, the selective signal $SELpN_3$ is set to the negative selective potential VselpN. As a result, the pre-charge circuit 26 supplies the first negative-polarity pre-charge signal VprN1 to the data line $\mathbf{34}_{g_3}$ in the supply period E1 of the horizontal scanning period $H_{m+2}$ and supplies the second negative-polarity pre-charge signal VprN2 to the data line $\mathbf{34}_{g_3}$ in the supply period L1 of the horizontal scanning period $H_{m+2}$. In addition, in the supply periods E2 and L2 of the horizontal scanning period $H_{m+2}$, the selective signal $SELpN_1$ is set to the negative selective potential VselpN. As a result, the pre-charge circuit 26 supplies the first negative-polarity pre-charge signal VprN1 to the data line $\mathbf{34}_{g_1}$ in the supply period E2 of the horizontal scanning period $H_{m+2}$ and supplies the second negative-polarity pre-charge signal VprN2 to the data line $\mathbf{34}_{g_1}$ in the supply period L2 of the horizontal scanning period $H_{m+2}$.

Note that, as illustrated in FIG. 7, in the first exemplary embodiment, the polarity of the potential of the first negative-polarity pre-charge signal VprN1 (which is referred to as a first negative pre-charge potential VprN1Lv and which is one example of "first potential") is set opposite to the polarity of the data signal Vd (positive polarity in the example of FIG. 7). Note that, hereinafter, the first positive pre-charge potential VprP1Lv and the first negative pre-charge potential VprN1Lv may be collectively referred to as a first pre-charge potential Vpr1Lv.

In addition, the polarity of the potential of the second positive-polarity pre-charge signal VprN2 (which is referred to as a second negative pre-charge potential VprN2Lv and which is one example of "second potential") is set identical to the polarity of the data signal Vd (negative polarity in the example of FIG. 7). That is, the second negative pre-charge potential VprN2Lv is a potential different from the first negative pre-charge potential VprN1Lv. The second negative pre-charge potential VprN2Lv, for example, may be set to a potential in the center of amplitude of the data potential VdLv or a mean value of the data potential VdLv. Note that, hereinafter, the second positive pre-charge potential VprP2Lv and the second negative pre-charge potential VprN2Lv may be collectively referred to as a second pre-charge potential Vpr2Lv.

Note that, although not illustrated, the data signal circuit 24 supplies a positive-polarity data signal Vd to the data line 34 in the example of FIG. 6, whereas the data signal circuit 24 supplies a negative-polarity data signal Vd to the data line 34 in the example of FIG. 7. Similarly, as illustrated in FIG. 7, in a case that the electro-optical device 10 is in the negative polarity driving mode, the positive selective potential VselpP is not set to the selective signals $SELpP_1$ to $SELpP_3$.

1.4. Simple Description of First Exemplary Embodiment

In the first exemplary embodiment described above, in one horizontal scanning period H, the pre-charge signal Vpr is supplied, prior to the supply of the data signal Vd, to the Q data lines 34*g* out of the R data lines 34*g* included in one wire line group $LG_g$, and the pre-charge signal Vpr is not supplied to the (R−Q) data lines 34*g* included in one wire line group $LG_g$. Thus, in one horizontal scanning period H, for example, compared with a case in which the data signal Vd is supplied to each of the R data lines 34*g* after the pre-charge signal Vpr is supplied, that is, a case in which a period for supplying the pre-charge signal Vpr is provided for every data line 34, a time during which the data signal Vd is written in the pixels Px can be sufficiently secured. Thus, according to the first exemplary embodiment, the pre-charge signal Vpr can be supplied while a time during which the data signal Vd is written in the pixels Px is secured.

In addition, according to the first exemplary embodiment, the R horizontal scanning periods H are regarded as one cycle, and the pre-charge signal Vpr is supplied to each date line 34 Q times for the one cycle. That is, according to the first exemplary embodiment, the number of times the pre-charge signal Vpr is supplied to the R data lines 34 over the R horizontal scanning periods H is uniformized, compared with a case in which the R data lines 34 are classified into, for example, the data lines 34 to which the pre-charge signal Vpr is supplied R times for the one period and the data lines 34 to which the pre-charge signal Vpr is not supplied even once in the R horizontal scanning periods H. That is, in the first exemplary embodiment, influence on display quality due to the supply of the pre-charge signal Vpr is uniformized over the entire display unit 30.

Furthermore, according to the first exemplary embodiment, the pre-charge signal Vpr is not supplied to the J data lines 34*g* out of the R data lines 34*g* included in one wire line group $LG_g$ in each horizontal scanning period H, which enables the reduction of power consumption used for pre-charging, compared with a case in which the pre-charge signal Vpr is supplied to the whole of the R data lines 34*g* included in one wire line group $LG_g$.

In addition, in the first exemplary embodiment, the polarity of the second pre-charge potential Vpr2Lv is set identical to the polarity of the data potential VdLv. Thus, in a case that the second pre-charge signal Vpr2 that is set to a potential close to the data potential VdLv is supplied to the pixel electrode 41 before the supply of the data signal Vd, a difference between the potential of the pixel electrode 41 and a potential written in the pixels Px (the data potential VdLv) is reduced, compared with a case in which the second pre-charge signal Vpr2 is not supplied to the pixel electrode 41 before the supply of the data signal Vd. As a result, in the case that the second pre-charge signal Vpr2 is supplied, the writing of the data signal Vd into the pixels Px is facilitated, compared with the case in which the second pre-charge signal Vpr2 is not supplied.

In addition, according to the first exemplary embodiment, the start time $t_{Lq}$ of the supply period Lq of the second pre-charge signal Vpr2 is later than the start time $t_{L(q-1)}$ of the supply period L(q−1). Thus, the pre-charge circuit 26 starts the supply of the second pre-charge signal Vpr2 to the Q data lines $34_gK$ to be pre-charged that are included in one wire line group $LG_g$ at different timings. Thus, variation in the potential of the data lines 34 that is caused in the case that the supply of the second pre-charge signal Vpr2 is started is reduced, compared with the case in which the supply periods L1 to LQ are started at an identical time. That is, according to the first exemplary embodiment, noise can be reduced that is attributed to the variation in the potential of the data lines 34 in response to the start of the supply of the second pre-charge signal Vpr2, compared with the case in which the supply periods L1 to LQ are started at an identical time.

Furthermore, in the first exemplary embodiment, the first pre-charge signal Vpr1 whose polarity is set opposite to the polarity of the data signal Vd is supplied to the data lines 34, and thus the uniformity of display quality of the images displayed by the display unit 30 is improved, compared with the case in which the first pre-charge signal Vpr1 is not supplied. Hereinafter, to describe the effect of supplying the first pre-charge signal Vpr1, a configuration (comparison example) in which the first pre-charge signal Vpr1 is not supplied to the data lines 34 in the electro-optical device 10 in which the polarity of the data potential VdLv is inverted for each vertical scanning period F will be described.

Figure 16:
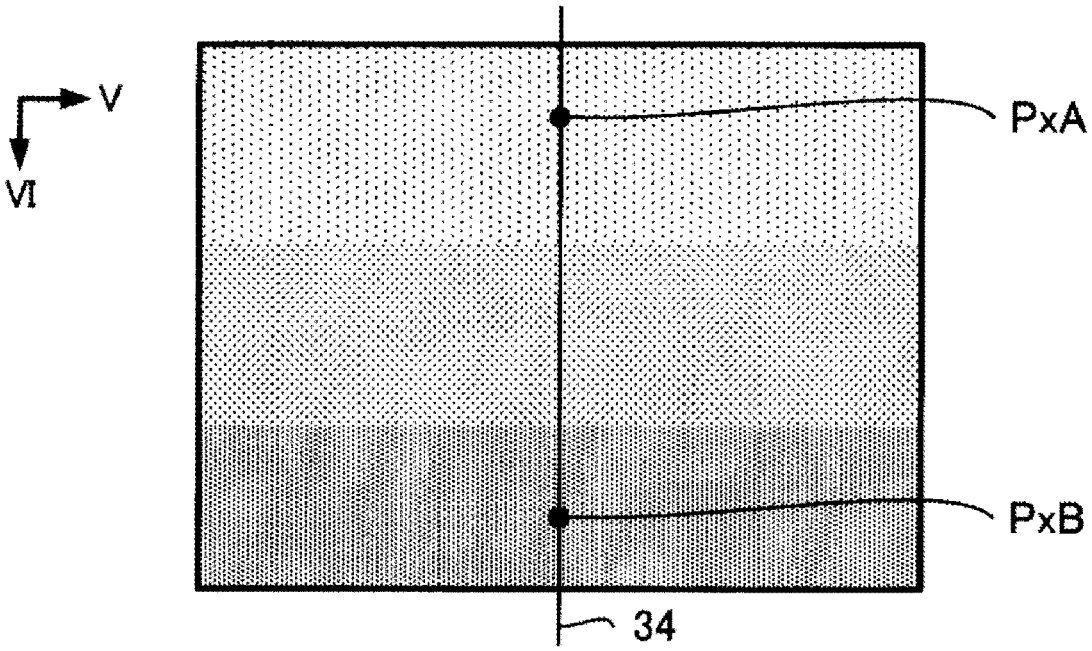
FIG. 16 is an explanatory diagram of an image displayed by an electro-optical device according to a comparison example.

FIG. 16 is a diagram for illustrating a gray image displayed by the display unit 30 of the electro-optical device 10 according to the comparison example. In FIG. 16, two pixels corresponding to one data line 34 are referred to as PxA and PxB. The pixel PxB is located in a +VI direction with respect to the pixel PxA. It is assumed that the data signal Vd that designates an identical gray-scale level is written into the pixel PxA and the pixel PxB.

In one vertical scanning period F, it is assumed that the electro-optical device 10 according to the comparison example is in the negative polarity driving mode. The polarity of a potential held by one pixel Px and the polarity of a potential of the data line 34 are reverse to each other from a time when the one vertical scanning period F is started to a time when a scanning line 32 corresponding to the one pixel Px is selected. Thus, the potential of the pixel Px is reduced with respect to a potential originally held by the pixel Px according to a difference between the potential held by the pixel Px and the potential of the data line 34, in accordance with length of time during which the scanning line 32 corresponding to the pixel Px is selected, and thus the pixel Px displays darker gray than the pixel Px originally displays.

When the scanning line 32 is sequentially selected in the +VI direction, the length of time during which the scanning line 32 corresponding to the pixel PxB is selected is greater than the length of time during which the scanning line 32 corresponding to the pixel PxA is selected. That is, the pixel PxB displays a dark gray, compared with the pixel PxA. Thus, in the comparison example, in the section on a −VI direction side and the section on a+VI direction side of the image displayed by the display unit 30, a gray-scale level to be displayed is different.

In contrast, in the first exemplary embodiment, the first pre-charge signal Vpr1 whose polarity is set opposite to the polarity of the data signal Vd is supplied to the data lines 34. Thus, regarding the pixel PxA, a difference between the potential to be held and the potential of the data line 34 can be increased, and regarding the pixel PxB, a difference between the potential to be held and the potential of the data line 34 can be decreased, compared with the comparison example. That is, according to the first exemplary embodiment, a difference between a gray-scale level displayed by the pixel PxA and a gray-scale level displayed by the pixel PxB can be reduced, compared with the comparison example.

As described above, the first pre-charge signal Vpr1 and the second pre-charge signal Vpr2 are supplied to the data lines 34 at two steps, which enables the uniformity of display quality of the images displayed by the electro-optical device 10 and facilitates the writing of the data signal Vd into the pixels Px. As a result, the display quality of the images displayed by the electro-optical device 10 is improved, compared with the configuration in which the pre-charge signal Vpr is not supplied to the data lines 34, or a case in which either one of the first pre-charge signal Vpr1 or the second pre-charge signal Vpr2 is supplied to the data lines 34.

Second Exemplary Embodiment

A second exemplary embodiment of the disclosure will be described. Note that, in each mode exemplified below, regarding an element having action or function identical to the action or function in the first exemplary embodiment, the reference number referred to in the description above is used, and the detailed description of the element is appropriately omitted.

Figure 8:
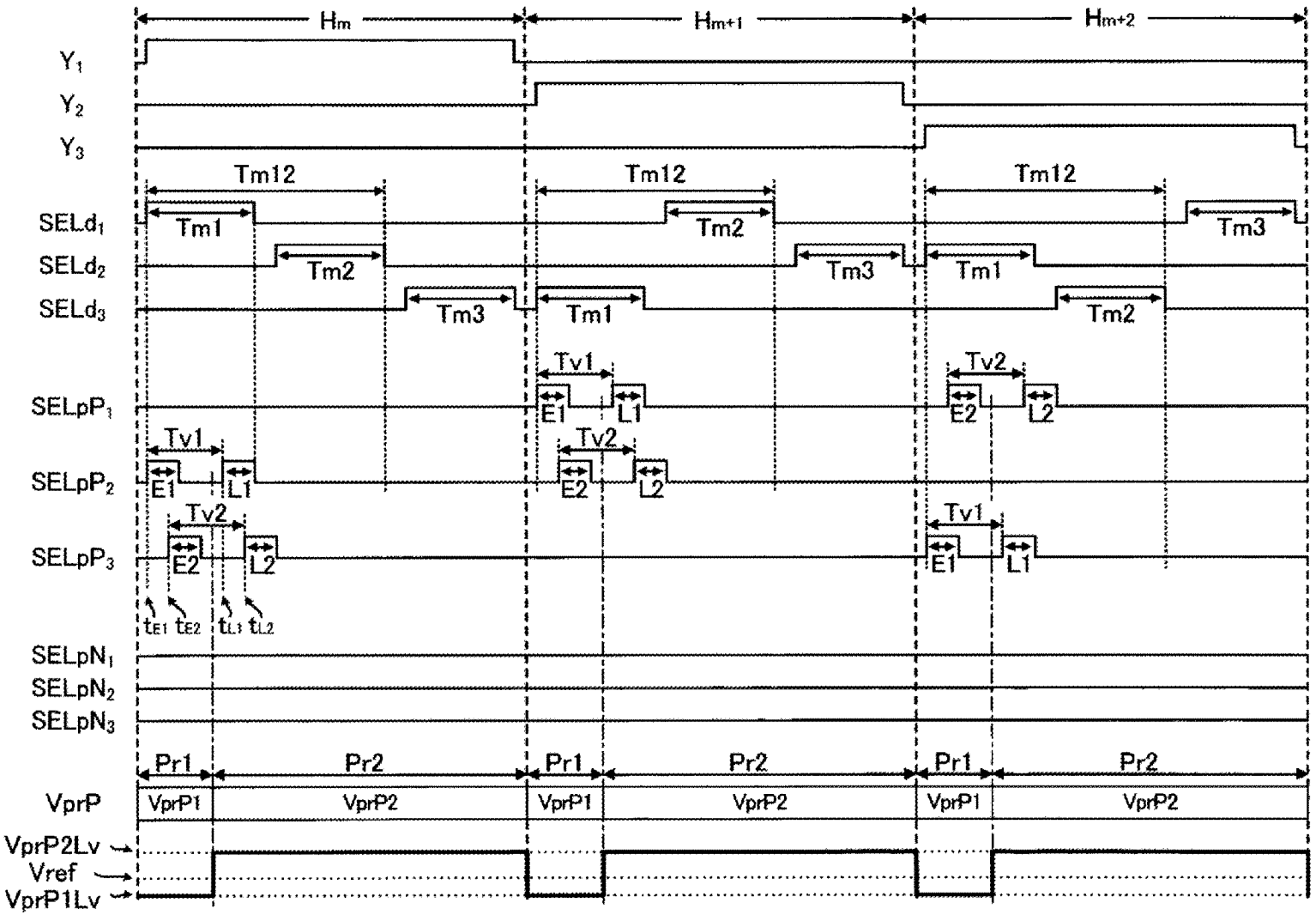
FIG. 8 is a timing chart for illustrating an operation of an electro-optical device according to a second exemplary embodiment.
Figure 9:
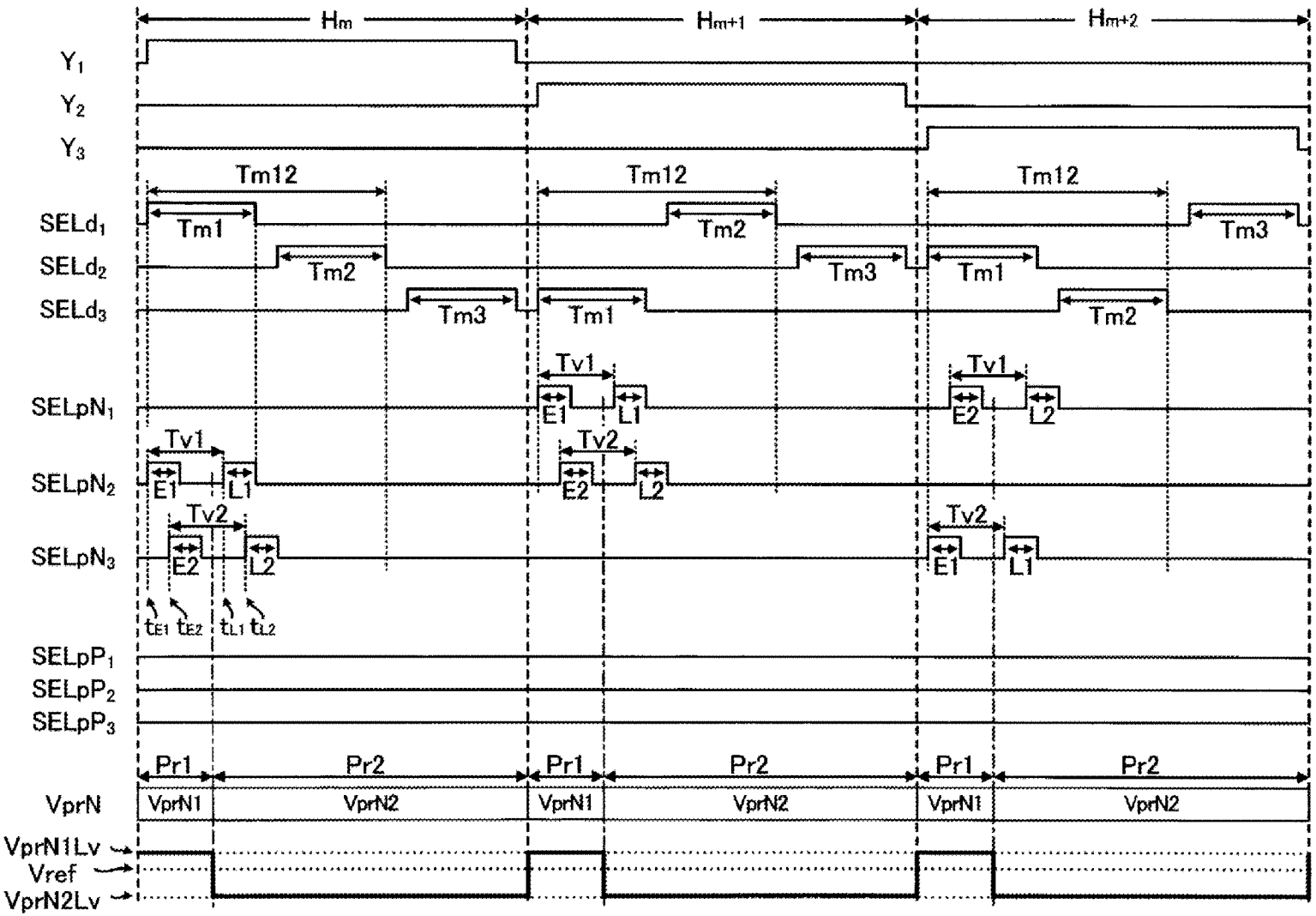
FIG. 9 is a timing chart for illustrating an operation of an electro-optical device according to the second exemplary embodiment.

FIGS. 8 and 9 are timing charts for illustrating one example of the operation of the electro-optical device 10 according to the second exemplary embodiment. FIG. 8 is a timing chart in the case that the electro-optical device 10 is in the positive polarity driving mode, and FIG. 9 is a timing chart in the case that the electro-optical device 10 is in the negative polarity driving mode. As is the case with the first exemplary embodiment, in each horizontal scanning period H, the R data lines 34*g* included in the wire line group $LG_g$ are classified into the Q data lines $\mathbf{34}_g$K to be pre-charged and the (R−Q) data lines $\mathbf{34}_g$N not to be pre-charged. In addition, as is the case with the first exemplary embodiment, the data signal circuit 24 supplies the data signal Vd to the data line $\mathbf{34}_g$Nj in the selective period Tmj and supplies the data signal Vd to the data line $\mathbf{34}_g$Kq in the selective period Tm(R−Q+q).

The second exemplary embodiment is identical to the first exemplary embodiment in that the pre-charge circuit 26 supplies the first pre-charge signal Vpr1 and the second pre-charge signal Vpr2 to the Q data lines $\mathbf{34}_g$K included in the wire line group $LG_g$ in the selective periods Tm1 to Tm(R−1). More specifically, the pre-charge circuit 26 supplies the first pre-charge signal Vpr1 in the supply periods E1 to EQ included in the selective periods Tm1 to Tm(R−Q) and supplies the second pre-charge signal Vpr2 in the supply periods L1 to LQ included in the selective periods Tm(R−Q) to Tm(R−1). Hereinafter, length of time ranging from the start of the supply period Eq to the start of the supply period Lq is referred to as an interval period Tvq.

In the first exemplary embodiment, the case in which the start times of the supply periods E1 to EQ are approximately equal has been described. However, in the second exemplary embodiment, the times at which the supply periods E1 to EQ are started are different from each other. More specifically, in the second exemplary embodiment, a start time $t_{Eq}$ at which the supply period Eq is started is later than a start time $t_{E(q-1)}$ at which the supply period E(q−1) is started. In other words, the pre-charge circuit 26 according to the second exemplary embodiment starts the supply of the first pre-charge signal Vpr1 to each of the Q data lines $\mathbf{34}_g$K at different timings. Note that the second exemplary embodiment is similar to the first exemplary embodiment in that the times at which the supply periods L1 to LQ are started are different. More specifically, in the second exemplary embodiment, a start time $t_{Lq}$ at which the supply period Lq is started is later than a start time $t_{L(q-1)}$ at which the supply period L(q−1) is started.

Furthermore, in the second exemplary embodiment, interval periods Tv1 to TvQ are approximately equal to each other. More specifically, in the second exemplary embodiment, a case in which the interval period Tv(q−1) ranging from the start of the supply period E(q−1) to the start of the supply period L(q−1) and the interval period Tvq ranging from the start of the supply period Eq to the start of the supply period Lq are approximately equal is exemplified and described. In other words, in the second exemplary embodiment, the lengths of times during which the first pre-charge signal Vpr1 is held by the Q data lines $\mathbf{34}_g$K included in the wire line group $LG_g$ are approximately equal to each other.

Hereinafter, a difference between the first exemplary embodiment and the second exemplary embodiment will be specifically described with reference to FIGS. 8 and 9. Note that, in the second exemplary embodiment, a case in which R=3, and Q=2 is exemplified and described. That is, each horizontal scanning period H includes three (R) selective periods Tm1 to Tm3, and the wire line group $LG_g$ includes two (Q) data lines $\mathbf{34}_g$K1 and $\mathbf{34}_g$K2 to be pre-charged and one (J) data line $\mathbf{34}_g$N1 not to be pre-charged. In addition, the supply periods E1 and E2 (the supply periods E1 to EQ) are included in the selective periods Tm1 to Tm(R−Q), that is, the selective period Tm1. In addition, the supply periods L1 and L2 (the supply periods L1 to LQ) are included in the selective periods Tm(R−Q) to Tm(R−1), that is, the selective periods Tm1 to Tm2. In addition, as is the case with the first exemplary embodiment, the supply period E2 and the supply period L2 are included in the selective period Tm12.

As illustrated in FIGS. 8 and 9, as is the case with the first exemplary embodiment, in the second exemplary embodiment, in each horizontal scanning period H, the start time $t_{Lq}$ (that is, the start time $t_{L2}$) of the supply period Lq (that is, the supply period L2) is later than the start time $t_{L(q-1)}$ (that is, the start time $t_{L1}$) of the supply period L(q−1) (that is, the supply period L1). Furthermore, in the second exemplary embodiment, in each horizontal scanning period H, the start time $t_{Eq}$ (that is, the start time $t_{E2}$) of the supply period Eq (that is, the supply period E2) is later than the start time $t_{E(q-1)}$ (that is, the start time $t_{E1}$) of the supply period E(q−1) (that is, the supply period E1). Thus, the pre-charge circuit 26 starts the supply of the first pre-charge signal Vpr1 to each of two (Q) data lines $\mathbf{34}_g$K in the wire line group $LG_g$ at different timings.

Note that, as is the case with the first exemplary embodiment, the supply period E1 is one example of "first supply period", the supply period L1 is one example of "second supply period", the supply period E2 is one example of "third supply period", and the supply period L2 is one example of "fourth supply period".

In addition, as illustrated in FIGS. 8 and 9, in the second exemplary embodiment, in each horizontal scanning period H, the interval period Tv(q−1), that is, the interval period Tv1 ranging from the start time $t_{E1}$ of the supply period E1 to the start time $t_{L1}$ of the supply period L1, and the interval period Tvq, that is, the interval period Tv2 ranging from the start time $t_{E2}$ of the supply period E2 to the start time $t_{L2}$ of the supply period L2 are approximately equal. In other words, for example, in the horizontal scanning period $H_m$, the length of time during which the first pre-charge signal Vpr1 is held in the data lines $\mathbf{34}_{g_2}$ and the length of time during which the first pre-charge signal Vpr1 is held in the data lines $\mathbf{34}_{g_3}$ are approximately equal.

The second exemplary embodiment described above also achieves an effect identical to the effect of the first exemplary embodiment. Furthermore, in the second exemplary embodiment, the start time $t_{Eq}$ of the supply period Eq is later than the start time $t_{E(q-1)}$ of the supply period E(q−1). Thus, in the second exemplary embodiment, the timings of starting the supply of the first pre-charge signal Vpr1 are different from each other among the Q data lines $\mathbf{34}_g$K to be pre-charged that are included in one wire line group $LG_g$. Thus, in the second exemplary embodiment, noise can be reduced that is attributed to the variation in the potential of the data lines 34 in response to the start of the supply of the first pre-charge signal Vpr1, compared with the case (e.g., the exemplary embodiment 1) in which the supply periods E1 to EQ are started at an identical time.

3. Third Exemplary Embodiment

Figure 10:
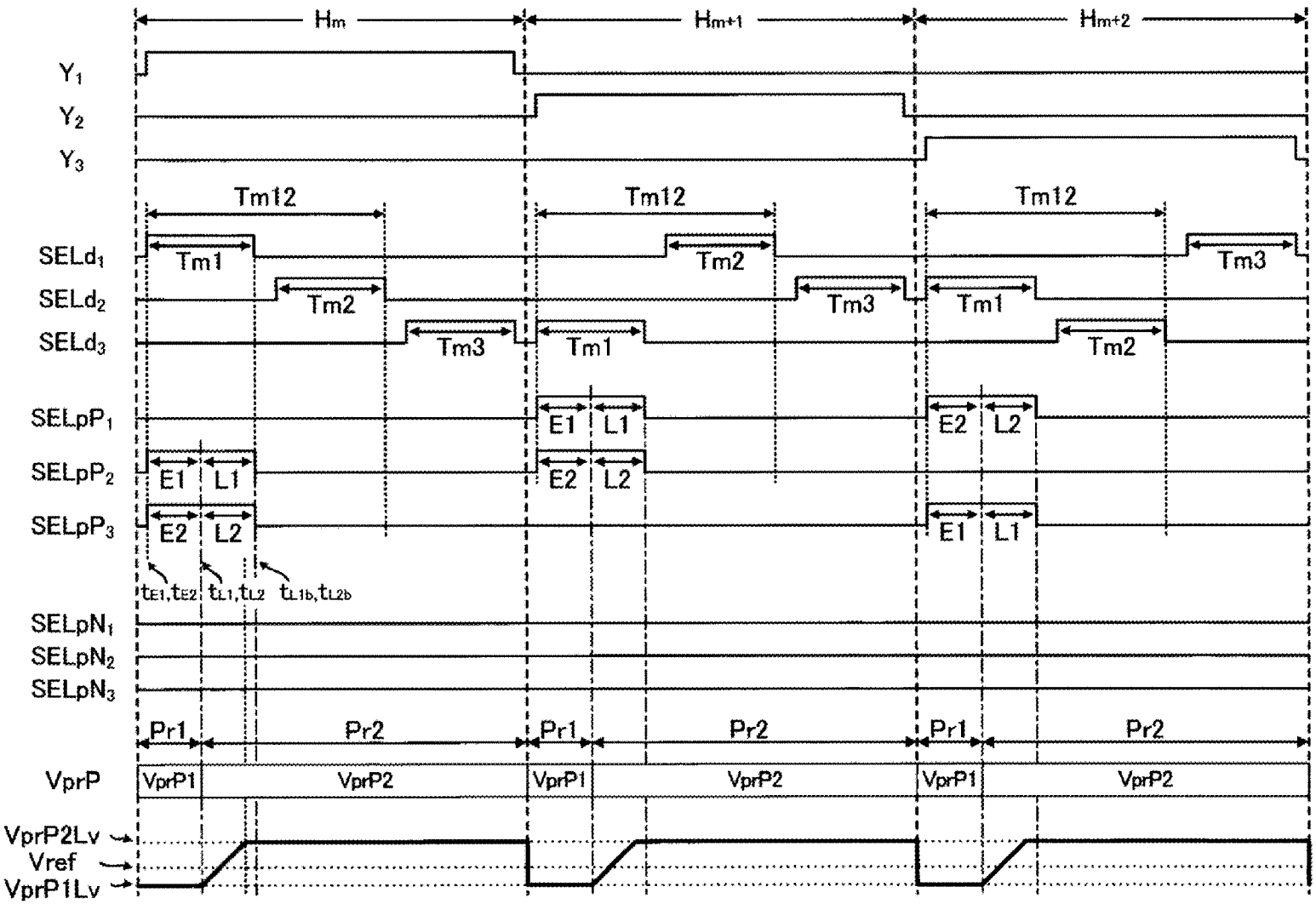
FIG. 10 is a timing chart for illustrating an operation of an electro-optical device according to a third exemplary embodiment.
Figure 11:
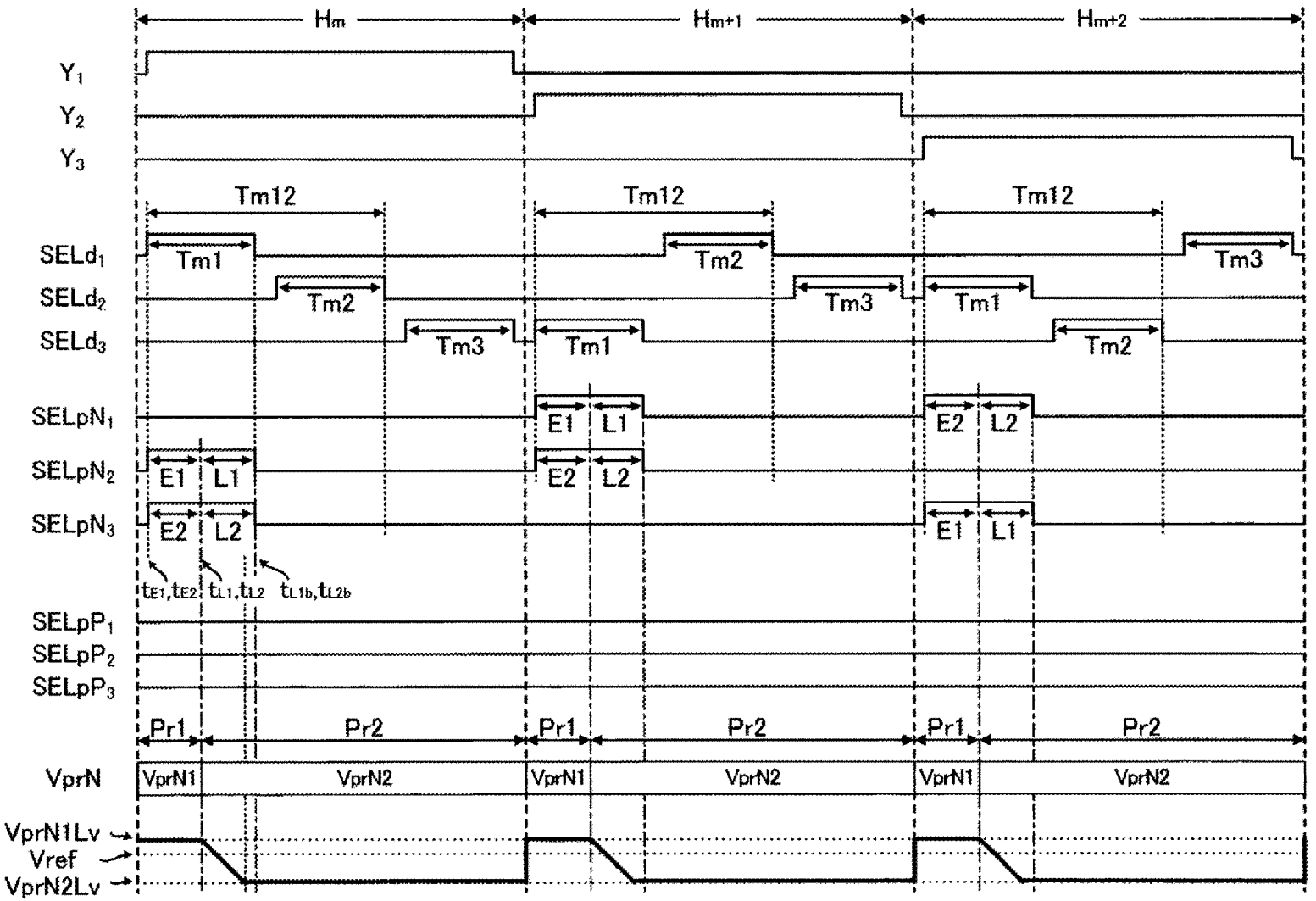
FIG. 11 is a timing chart for illustrating an operation of an electro-optical device according to the third exemplary embodiment.

A third exemplary embodiment of the disclosure will be described. FIGS. 10 and 11 are timing charts for illustrating one example of the operation of the electro-optical device 10 according to the third exemplary embodiment. FIG. 10 is a timing chart in the case that the electro-optical device 10 is in the positive polarity driving mode, and FIG. 11 is a timing chart in the case that the electro-optical device 10 is in the negative polarity driving mode. As is the case with the exemplary embodiments described above, in the third exemplary embodiment, in each horizontal scanning period H, the R data lines 34*g* included in the wire line group $LG_g$ are classified into the Q data lines $\mathbf{34}_g$K to be pre-charged and the (R−Q) data lines $\mathbf{34}_g$N not to be pre-charged. In addition, as is the case with the exemplary embodiments described above, the data signal circuit 24 supplies the data signal Vd to the data line $\mathbf{34}_g$Nj in the selective period Tmj and supplies the data signal Vd to the data line $\mathbf{34}_g$Kq in the selective period Tm(R−Q+q).

In the exemplary embodiments described above, the case in which the pre-charge circuit 26 supplies the first pre-charge signal Vpr1 and the second pre-charge signal Vpr2 to the Q data lines $\mathbf{34}_g$K included in the wire line group $LG_g$ in the selective periods Tm1 to Tm(R−1) has been exemplified. However, in the third exemplary embodiment, the pre-charge circuit 26 supplies the first pre-charge signal Vpr1 and the second pre-charge signal Vpr2 to the Q data lines $\mathbf{34}_g$K included in the wire line group $LG_g$ in the selective periods Tm1 to Tm(R−Q). That is, in the third exemplary embodiment, the supply periods E1 to EQ and the supply periods L1 to LQ are included in the selective periods Tm1 to Tm(R−Q). Note that, as is the case with the exemplary embodiments described above, the supply period Eq completes before the start of the supply period Lq.

In addition, in the third exemplary embodiment, it is assumed that the start times of the supply periods E1 to EQ are approximately equal, and that the start times of the supply periods L1 to LQ are approximately equal. However, in the third exemplary embodiment, the pre-charge circuit 26 gradually changes a potential set to the second pre-charge signal Vpr2 from the first pre-charge potential Vpr1Lv to the second pre-charge potential Vpr2Lv over the supply period Lq.

Hereinafter, a difference between the first exemplary embodiment and the third exemplary embodiment will be specifically described with reference to FIGS. 10 and 11. Note that, in the third exemplary embodiment, the case in which R=3, and Q=2 is exemplified and described. That is, in the third exemplary embodiment, the supply periods E1 and E2 (the supply periods E1 to EQ) and the supply periods L1 and L2 (the supply periods L1 to LQ) are included in the selective periods Tm1 to Tm(R−Q), that is, the selective period Tm1.

As illustrated in FIGS. 10 and 11, in each horizontal scanning period H, the potential of the second pre-charge signal Vpr2 changes from the first pre-charge potential Vpr1Lv (VprP1Lv or VprN1Lv) to the second pre-charge potential Vpr2Lv (VprP2Lv or VprN2Lv) over the supply period Lq in the selective period Tm1.

Note that, in FIGS. 10 and 11, an example in which a potential set to the second pre-charge signal Vpr2 linearly changes is illustrated, but the potential set to the second pre-charge signal Vpr2 may be curvedly (e.g., exponentially) changed. In addition, in FIGS. 10 and 11, an example in which a potential set to the second pre-charge signal Vpr2 reaches the second pre-charge potential Vpr2Lv prior to the finish time $t_{L1b}$ of the supply period L1 and the finish time $t_{L2b}$ of the supply period L2 is illustrated, but the potential set to the second pre-charge signal Vpr2 may reach the second pre-charge potential Vpr2Lv by the earlier of the finish time $t_{L1b}$ and the finish time $t_{L2b}$.

In addition, in the third exemplary embodiment, it is assumed that the start times of the supply periods E1 to EQ are approximately equal, but the start times of the supply periods E1 to EQ may be different from each other. For example, in FIGS. 10 and 11, an example in which the start time $t_{E1}$ of the supply period E1 and the start time $t_{E2}$ of the supply period E2 are approximately equal is illustrated, but the start time $t_{E2}$ may be later than the start time $t_{E1}$.

The third exemplary embodiment described above also achieves an effect identical to the effect of the first exemplary embodiment. More specifically, in the third exemplary embodiment, the potential of the second pre-charge signal Vpr2 changes from the first pre-charge potential Vpr1Lv to the second pre-charge potential Vpr2Lv over the supply period Lq. Thus, even when the start times of the supply periods L1 to LQ are approximately equal, the noise attributed to the variation in the potential of the data lines 34 in response to the start of the supply of the second pre-charge signal Vpr2 is reduced.

4. Modification Example

The exemplary embodiments above can be variously modified. Specific modified modes are exemplified below. The exemplary embodiments above and two or more modes freely selected from exemplifications below can be appropriately used in combination as long as mutual contradiction does not arise. Note that, in modified examples exemplified below, regarding an element having action or function identical to the action or function in some exemplary embodiments describe above, and the reference number referred to in the description above is used, the detailed description of the element is appropriately omitted.

Figure 12:
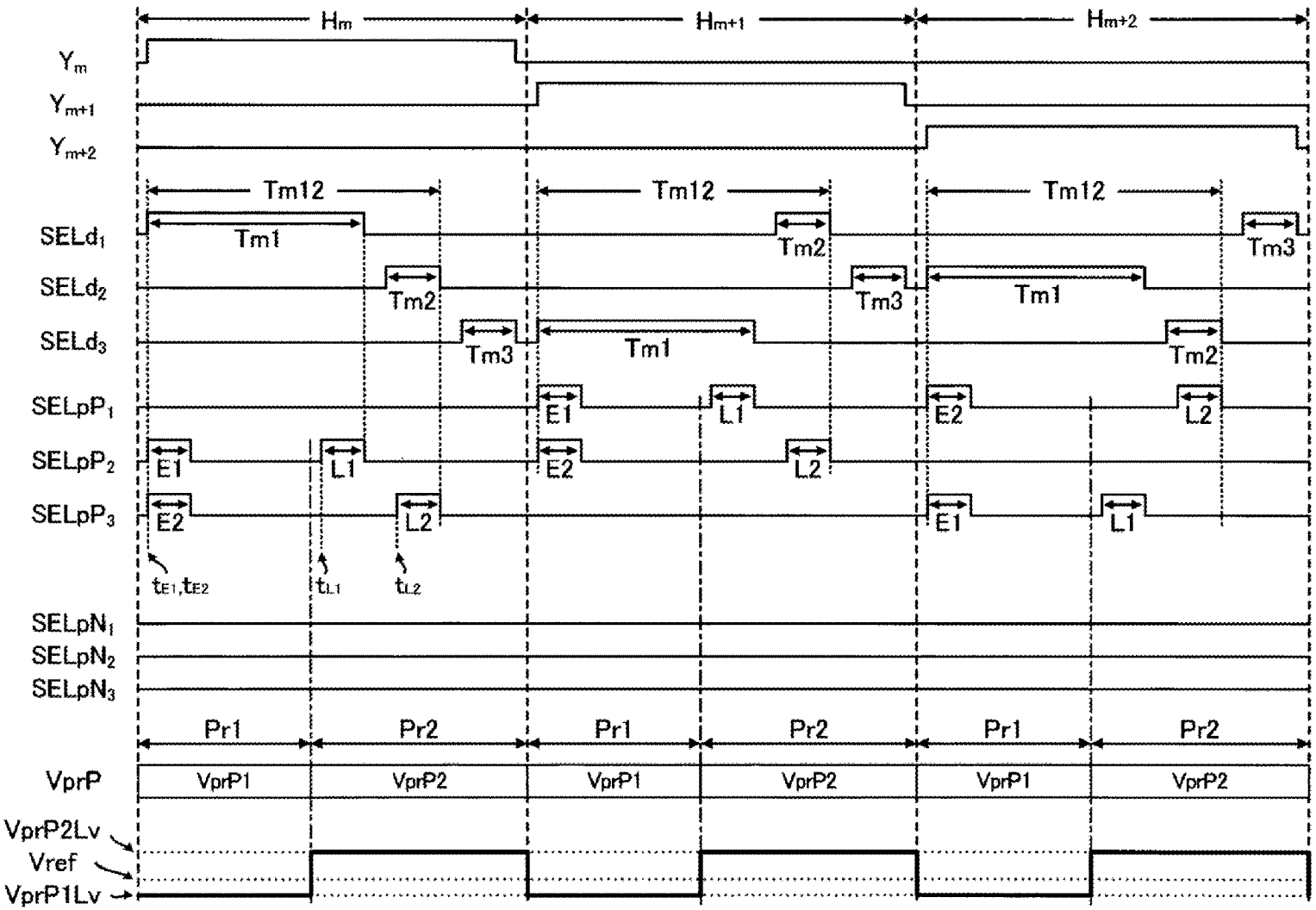
FIG. 12 is a timing chart for illustrating an operation of an electro-optical device according to a modified example.

In some exemplary embodiments described above, the case in which the lengths of times during which the data signal Vd is supplied to the R data lines 34*g* included in the wire line group $LG_g$ are approximately equal to each other has been exemplified, but the lengths of times may be different. More specifically, in some exemplary embodiments and modified examples described above, it has been assumed that the R selective periods Tm1 to TmR included in each horizontal scanning period H are approximately equal to each other in terms of length of time, but may be different from each other. For example, as illustrated in FIG. 12, the length of time of the selective period Tmj may be set greater than the length of time of the selective period Tm(R−Q+q).

5. Application Example

Figure 13:
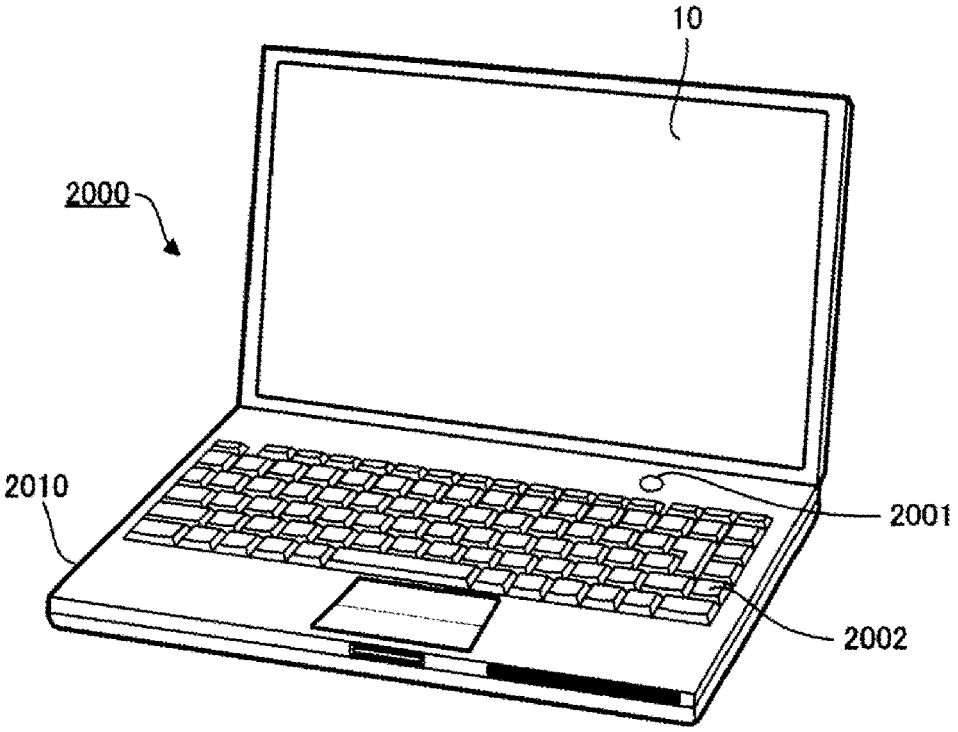
FIG. 13 is a perspective diagram illustrating one example of an electronic apparatus (personal computer).
Figure 14:
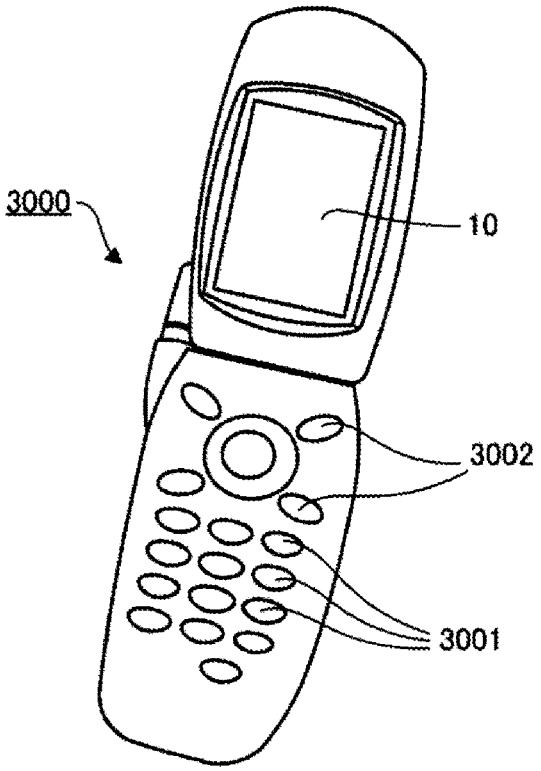
FIG. 14 is a perspective diagram illustrating one example of an electronic apparatus (mobile phone).
Figure 15:
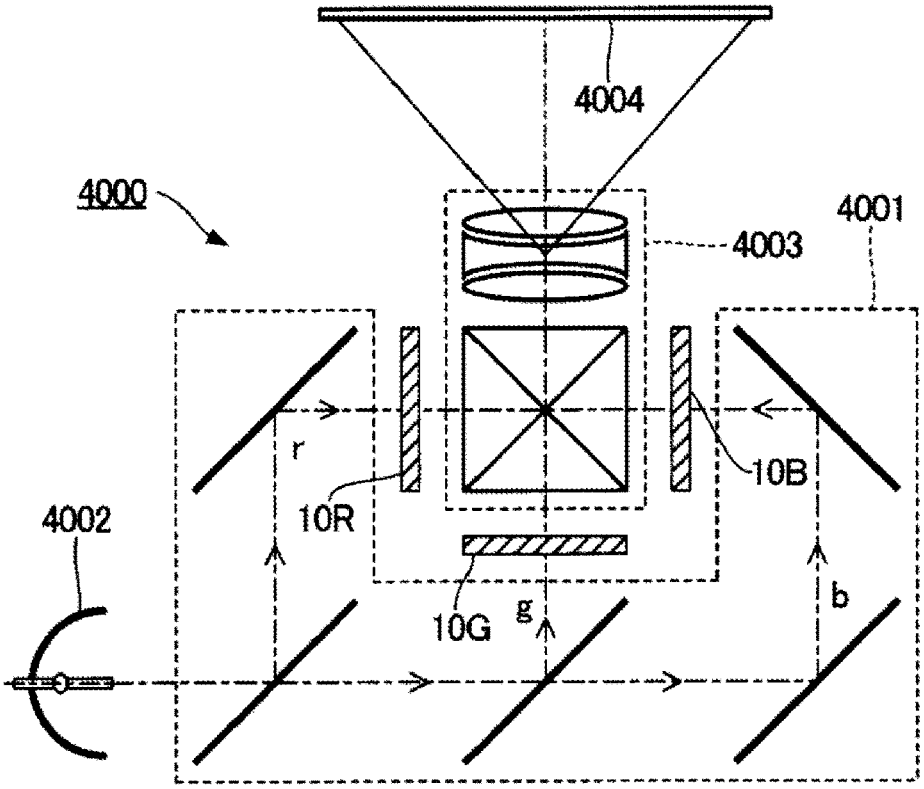
FIG. 15 is a perspective diagram illustrating one example of an electronic apparatus (projection-type display apparatus).

The electro-optical device 10 exemplified in some modes above can be used for various electronic apparatuses. In FIGS. 13 to 15, the specific modes of the electronic apparatuses in which the electro-optical device 10 is employed are exemplified.

FIG. 13 is a perspective diagram of a portable personal computer 2000 in which the electro-optical device 10 is employed. The personal computer 2000 includes the electro-optical device 10 that displays various images, and a main body portion 2010 in which a user interface including a power source switch 2001 and a keyboard 2002 is provided.

FIG. 14 is a perspective diagram of a mobile phone 3000 in which the electro-optical device 10 is employed. The mobile phone 3000 includes the electro-optical device 10 that displays various images, and a user interface including a plurality of operation buttons 3001 and a scroll button 3002. A user operates the scroll button 3002, which causes a screen displayed on the electro-optical device 10 to be scrolled.

FIG. 15 is an exemplary diagram of a projection-type display apparatus (for example, a three-plate type projector) 4000 in which the electro-optical device 10 is employed. The projection-type display apparatus 4000 includes three electro-optical devices 10 (10R, 10G, and 10B) corresponding to three colors, that is, red, green, and blue. An illumination optical system 4001 supplies a red element r of light emitted from a light source 4002 to the electro-optical device 10R, a green element g of the light to the electro-optical device 10G, and a blue element b of the light to the electro-optical device 10B. Each electro-optical device 10 functions as an optical modulator that modulates the light of the corresponding color component in accordance with a display image, the light being supplied from the illumination optical system 4001. A projection optical system 4003 combines the light emitted from each of electro-optical devices 10 and projects the combined light to a projection surface 4004.

Note that the electronic apparatuses in which the electro-optical device 10 according to the disclosure is employed are not limited to the examples above. The electro-optical device 10 may be employed for electronic apparatuses such as smart phones, portable information terminals (PDA: Personal Digital Assistants), digital still cameras, televisions, video cameras, car navigation apparatuses, in-vehicle displays, electronic organizers, electronic paper, calculators, word processors, videophones, POS terminals, printers, scanners, copiers, video players, and equipment including a touch panel.

It is understood from the descriptions above that the disclosure is applied for the electro-optical device 10, the driving method for electro-optical device 10, and the electronic apparatuses including the electro-optical device 10.

The entire disclosure of Japanese Patent Application No. 2017-179582, filed Sep. 19, 2017 is expressly incorporated by reference herein.

What is claimed is:

1. An electro-optical device comprising:

a first pixel provided corresponding to intersection of a first data line and a scanning line;

a second pixel provided corresponding to intersection of a second data line and the scanning line;

a third pixel provided corresponding to intersection of a third data line and the scanning line;

a data signal circuit configured to:

supply a first data signal to the first pixel via the first data line in a first period;

supply a second data signal to the second pixel via the second data line in a second period that is started after completion of the first period; and supply a third data signal to the third pixel via the third data line in a third period that is started after completion of the second period; and a pre-charge circuit configured to:

supply a first pre-charge signal to the second data line in a first supply period;

supply a second pre-charge signal to the second data line in a second supply period after the first supply period;

supply the first pre-charge signal to the third data line in a third supply period;

supply the second pre-charge signal to the third data line in a fourth supply periods; and not supply the first pre-charge signal to the first data line in the first period, wherein the first supply period and the second supply period are included in the first period, and the third supply period and the fourth supply period are included in a period from a start of the first period to completion of the second period.

2. The electro-optical device according to claim 1, wherein a time at which the first supply period is started is approximately equal to a time at which the third supply period is started, and a time at which the fourth supply period is started is later than a time at which the second supply period is started.

3. The electro-optical device according to claim 1, wherein a time at which the third supply period is started is later than a time at which the first supply period is started, and a time at which the fourth supply period is started is later than a time at which the second supply period is started.

4. The electro-optical device according to claim 1, wherein a length of time ranging from a start of the first supply period to a start of the second supply period and a length of time ranging from a start of the third supply period to a start of the fourth supply period are approximately equal.

5. The electro-optical device according to claim 1, wherein a potential of the second pre-charge signal changes from a first potential set to the first pre-charge signal to a second potential different from the first potential over a period in which the second pre-charge signal is supplied to the second data line, in the first period.

6. The electro-optical device according to claim 1, further comprising:

a plurality of scanning lines including the scanning line; and a scanning line drive circuit configured to sequentially select the plurality of scanning lines, wherein the scanning line drive circuit is configured to select the scanning line corresponding to the first pixel, the second pixel, and the third pixel in a horizontal period including the first period, the second period, and the third period.

7. An electronic apparatus comprising:

the electro-optical device according to claim 1.

8. A driving method for an electro-optical device including a first pixel provided corresponding to intersection of a first data line and a scanning line, a second pixel provided corresponding to intersection of a second data line and the scanning line, and a third pixel provided corresponding to intersection of a third data line and the scanning line, the driving method comprising:

supplying a first data signal to the first pixel via the first data line in a first period;

supplying a second data signal to the second pixel via the second data line in a second period that is started after completion of the first period;

supplying a third data signal to the third pixel via the third data line in a third period that is started after completion of the third period;

supplying a first pre-charge signal to the second data line in a first supply period;

supplying a second pre-charge signal to the second data line in a second supply period after the first supply period;

supply the second pre-charge signal to the third data line in a fourth supply period; and not supplying the first pre-charge signal to the first data line in the first period, wherein the first supply period and the second supply period are included in the first period, and the third supply period and the fourth supply period are included in a period from a start of the first period to completion of the second period.

* * * * *